US009637333B2

(12) United States Patent
Kuriki

(10) Patent No.: US 9,637,333 B2
(45) Date of Patent: May 2, 2017

(54) SHEET FEEDER PROVIDED WITH CONTROLLER FOR CONTROLLING OPERATIONS OF FEED ROLLER

(71) Applicant: Brother Kogyo Kabushiki Kaisha, Nagoya-shi, Aichi-ken (JP)

(72) Inventor: Yuichiro Kuriki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/082,029

(22) Filed: Mar. 28, 2016

(65) Prior Publication Data

US 2016/0289028 A1 Oct. 6, 2016

(30) Foreign Application Priority Data

Mar. 31, 2015 (JP) ..... 2015-071256

(51) Int. Cl.
*B65H 3/06* (2006.01)
*B65H 3/34* (2006.01)
(Continued)

(52) U.S. Cl.
CPC ..... *B65H 3/063* (2013.01); *B65H 3/0653* (2013.01); *B65H 3/0669* (2013.01); *B65H 3/34* (2013.01); *B65H 3/5284* (2013.01); *B65H 3/66* (2013.01); *B65H 7/18* (2013.01); *B65H 2402/46* (2013.01); *B65H 2403/42* (2013.01); *B65H 2403/72* (2013.01); *B65H 2403/942* (2013.01);
(Continued)

(58) Field of Classification Search
CPC . B65H 3/063; B65H 3/34; B65H 7/18; B65H 3/66; B65H 3/5284; B65H 3/0669; B65H 3/0653; B65H 2404/133; B65H 2403/42; B65H 2403/72; B65H 2511/212; B65H 2402/46; B65H 2513/50; B65H 2403/942; B65H 2513/10
See application file for complete search history.

(56) References Cited

U.S. PATENT DOCUMENTS 5,411,247 A * 5/1995 Ohsawa ..... B65H 3/063 271/119
6,059,281 A * 5/2000 Nakamura ..... B65H 3/0638 271/119
(Continued)

FOREIGN PATENT DOCUMENTS

JP H11-091972 A 4/1999

*Primary Examiner* — David H Bollinger
(74) *Attorney, Agent, or Firm* — Banner & Witcoff, Ltd.

(57) ABSTRACT

A sheet feeder includes: a feed roller; a shutter movable between a restricting position restricting a leading edge of a sheet and a non-restricting position releasing the restriction on the sheet; and a controller configured to control rotation of the feed roller and movement of the shutter. The controller is configured to perform: a first feeding process of controlling the feed roller to rotate at a first rotational speed while the shutter is at the restricting position and of controlling the shutter to move to the non-restricting position from the restricting position no earlier than rotation of the feed roller at the first rotational speed: a reduction process of controlling a rotational speed of the feed roller to be less than the first rotational speed; and a second feeding process of controlling the feed roller to rotate at a second rotational speed.

14 Claims, 10 Drawing Sheets

(51) Int. Cl.

| | |
|---|---|
| ***B65H 3/52*** | (2006.01) |
| ***B65H 3/66*** | (2006.01) |
| ***B65H 7/18*** | (2006.01) |

(52) U.S. Cl.
CPC .. *B65H 2404/133* (2013.01); *B65H 2511/212* (2013.01); *B65H 2513/10* (2013.01); *B65H 2513/50* (2013.01)

(56) References Cited

U.S. PATENT DOCUMENTS

| | | | | |
|---|---|---|---|---|
| 6,392,763 | B1 | 5/2002 | Nishinohara et al. | |
| 2005/0062214 | A1* | 3/2005 | Hanabusa ..... | B65H 3/0669 271/109 |
| 2006/0071400 | A1* | 4/2006 | Johnson ..... | B65H 1/04 271/121 |

* cited by examiner

SHEET FEEDER PROVIDED WITH CONTROLLER FOR CONTROLLING OPERATIONS OF FEED ROLLER

CROSS REFERENCE TO RELATED APPLICATION

This application claims priority from Japanese Patent Application No. 2015-071256 filed Mar. 31, 2015. The entire content of the priority application is incorporated herein by reference.

TECHNICAL FIELD

The present disclosure relates to a sheet feeder.

BACKGROUND

Conventionally, sheet feeders have had a separating function for separating and feeding a plurality of sheets from a paper tray in order to feed the sheets one at a time. With this type of sheet feeder, if a user inadvertently inserts a stack of sheets too far into the device when placing sheets on the paper tray, the sheets are likely to be more difficult to be separated and fed one at a time, often resulting in two or more sheets being fed simultaneously, i.e., a double-feed. Consequently, conventional sheet feeders are normally equipped with regulating means for preventing the stack of sheets from being inserted into the device too far in order to maximize the sheet-separating capacity of the sheet feeder.

For example, there is known a sheet-feeding device that includes a separation roller, a feed roller, and regulating means. The regulating means is movable between a restricting position for contacting leading edges of sheets inserted through an insertion opening to prevent the sheets from being inserted further, and a release position for releasing this restriction. The separation roller is configured to begin rotating after the regulating means has released the restriction on the inserted sheets, and start separating and conveying the sheets one at a time. The feed roller is configured to feed each sheet separated by the separating roller to an image sensor.

SUMMARY

According to an aspect of the disclosure, there is provided a sheet feeder including a feed roller, a shutter and a controller. The feed roller is configured to rotate to feed a sheet in a feeding direction, the sheet having a leading edge in the feeding direction. The shutter is configured to move between a restricting position and a non-restricting position, the shutter at the restricting position restricting the leading edge of the sheet to prevent the sheet from being conveyed by the feed roller in the feeding direction, the shutter at the non-restricting position releasing the restricting on the leading edge of the sheet to permit the sheet to be conveyed by the feed roller in the feeding direction. The controller is configured to control rotation of the feed roller and movement of the shutter, the controller being configured to perform: a first feeding process of controlling the feed roller to rotate at a first rotational speed while the shutter is at the restricting position and of controlling the shutter to move to the non-restricting position from the restricting position no earlier than rotating the feed roller at the first rotational speed; a reduction process of controlling a rotational speed of the feed roller to be less than the first rotational speed after performing the first feeding process; and a second feeding process of controlling the feed roller to rotate at a second rotational speed after performing the reduction process.

According to another aspect of the disclosure, there is provided a sheet feeder including a feed roller, a shutter and a controller. The feed roller is configured to rotate to feed a sheet in a feeding direction, the sheet having a leading edge in the feeding direction. The shutter is configured to move between a restricting position and a non-restricting position, the shutter at the restricting position restricting the leading edge of the sheet to prevent the sheet from being conveyed by the feed roller in the feeding direction, the shutter at the non-restricting position releasing the restricting on the leading edge of the sheet to permit the sheet to be conveyed by the feed roller in the feeding direction. The controller is configured to control rotation of the feed roller and movement of the shutter, the controller being configured to perform: a first feeding process of controlling the feed roller to rotate at a first rotational speed while the shutter is at the restricting position and of controlling the shutter to move to the non-restricting position from the restricting position no earlier than rotating the feed roller at the first rotational speed; one of a halting process of controlling the feed roller to halt rotation thereof and a speed-reduction process of controlling the feed roller to rotate at a rotational speed less than the first rotational speed after performing the first feeding process; and a second feeding process of controlling the feed roller to rotate after performing the one of the halting process and the speed-reduction process.

According to still another aspect of the disclosure, there is provided a sheet feeder including a casing, a feed roller, a shutter, a motor, a supporting member, an urging member, a transmission mechanism, a clutch, and a controller. In the casing, a sheet conveying path along which a sheet is configured to be conveyed is defined. The feed roller is configured to rotate to feed the sheet in a feeding direction, the sheet having a leading edge in the feeding direction. The shutter is movably disposed in the casing, the shutter being configured to move between a first position crossing the sheet conveying path and a second position separated away from the sheet conveying path, the shutter at the first position being in contact with the leading edge of the sheet to be fed by the feed roller. The motor includes a drive shaft configured to rotate in a first direction and in a second direction opposite the first direction to generate a drive force, the shutter being movable from the second position to the first position in response to rotation of the drive shaft in the first direction, the shutter being movable from the first position to the second position in response to rotation of the drive shaft in the second direction. The supporting member movably supports the shutter. The urging member is configured to urge the supporting member to move the shutter toward the second position. The transmission mechanism mechanically connects the drive shaft of the motor and the supporting member to transmit the drive force of the motor to the supporting member. The clutch constitutes part of the transmission mechanism, the clutch being configured to transmit the drive force to the supporting member in response to rotation of the drive shaft in the first direction, the clutch being configured to freewheel relative to the supporting member to prevent transmission of the second drive force to the supporting member in response to rotation of the drive shaft in the second direction. The controller is configured to control rotation of the feed roller and rotation of the drive shaft of the motor, the controller being configured to perform: a first feeding process of controlling the feed roller to start rotating while the shutter is at the restricting position and of controlling the drive shaft of the motor to start rotating to move the shutter to the non-restricting position from the restricting position no earlier than starting rotating the feed roller, the feed roller being configured to rotate at a first rotational speed; a reduction process of controlling a rotational speed of the feed roller to be less than the first rotational speed after performing the first feeding process; and a second feeding process of controlling the feed roller to rotate at a second rotational speed greater than the rotational speed in the reduction process after performing the reduction process.

BRIEF DESCRIPTION OF THE DRAWINGS

The particular features and advantages of the disclosure as well as other objects will become apparent from the following description taken in connection with the accompanying drawings, in which.

DETAILED DESCRIPTION

In the conventional sheet-feeding device provided with the regulating means, the separation roller begins rotating after the regulating means has released its restriction on the inserted sheets, at which time the leading edges of the stacked sheets are not aligned with each other. This disarray in the stacked sheets makes it difficult to separate the sheets reliably and can lead to problems in sheet conveyance. Therefore, it is preferable for the regulating means to release its restriction on the sheets at the same time or after the separation roller begins rotating. However, when the separation roller begins rotating at the same time or prior to the regulating means releasing its restriction on the sheets, the leading edge of the sheet conveyed by the separation roller will be pressed against the regulating means at the restricting position. This action increases a frictional force between the leading edge of the sheet and the regulating means, which force may hinder the regulating means from moving smoothly out of the restricting position. This phenomenon can lead to problems in sheet conveyance.

In view of the foregoing, it is an object of an embodiment of the present disclosure to provide a sheet feeder that can reduce a potential for sheet conveyance problems.

Hereinafter, an image-reading device 1 according to the embodiment will be described while referring to FIGS. 1 through 9.

1. Overall Structure of the Image-Reading Device 1

Figure 1:
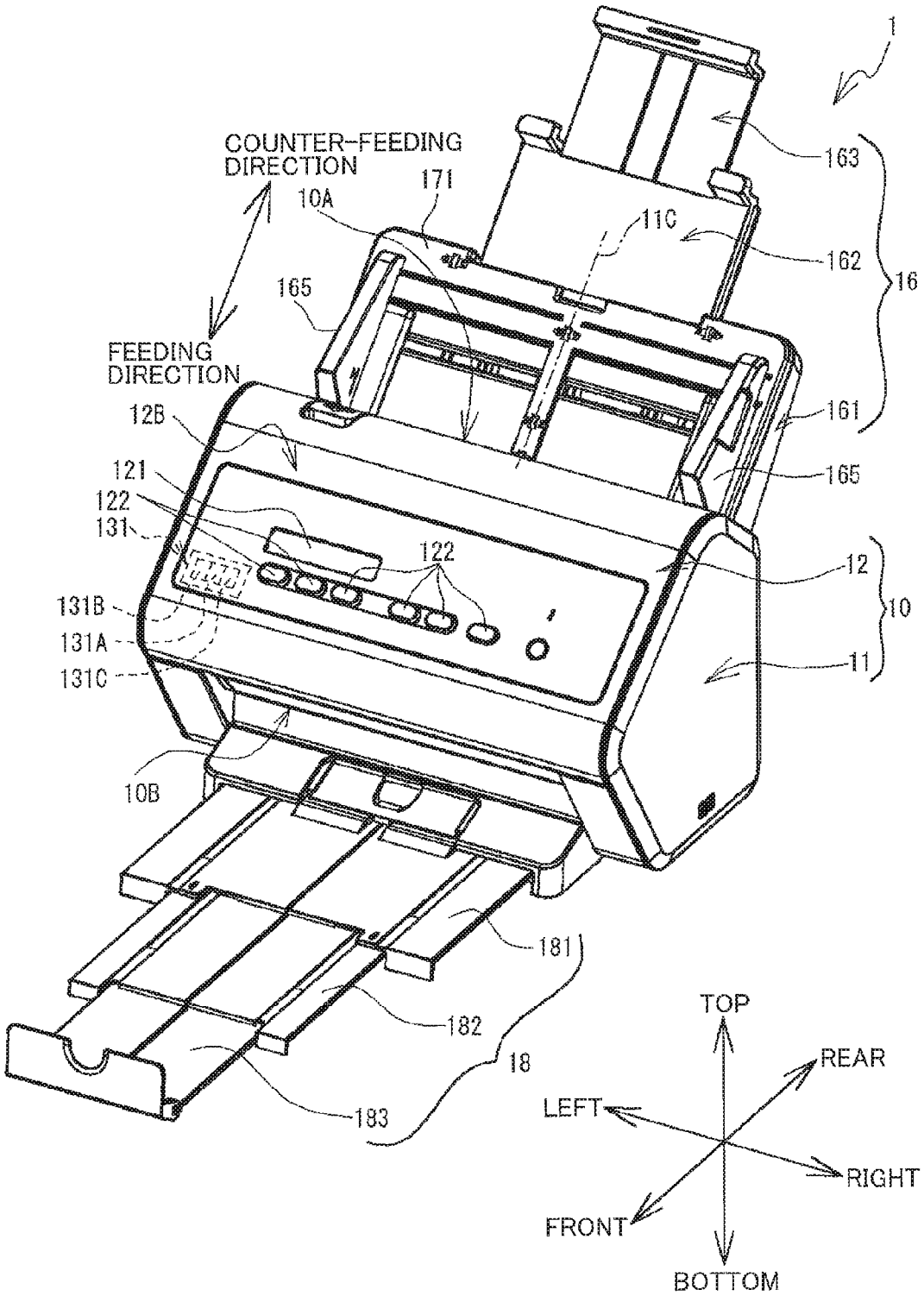
FIG. 1 is a perspective view showing an external construction of an image-reading device 1 according to an embodiment.
Figure 2:
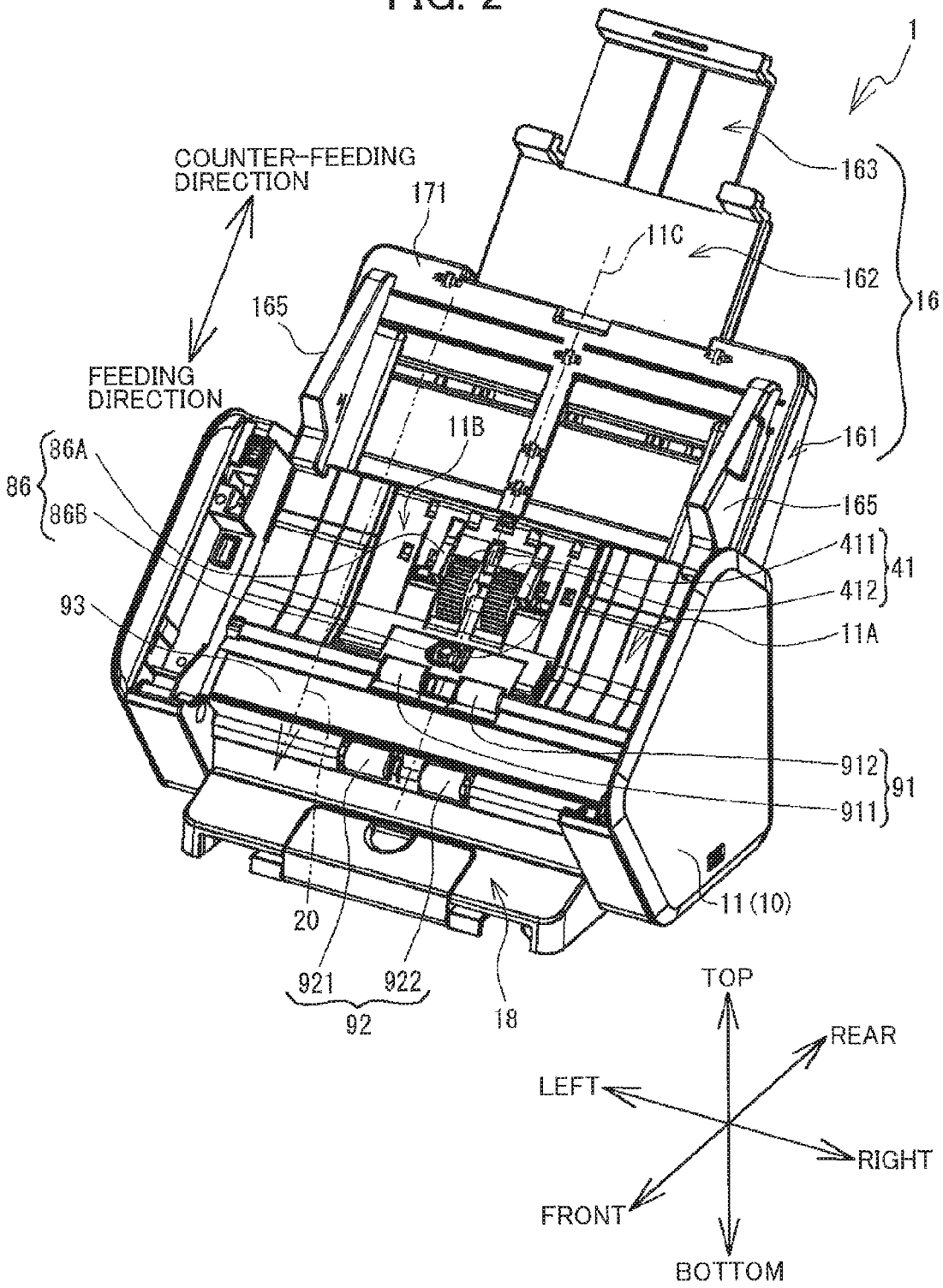
FIG. 2 is a perspective view showing a structure of the image-reading device 1 according to the embodiment, wherein a second casing 11 is removed.

As shown in FIGS. 1 and 2, the image-reading device 1 includes a casing 10, a sheet-feed tray 16, and a discharge tray 18.

In the following description, the top, bottom, upper-left, lower-right, lower-left, and upper-right sides in FIG. 1 will be referred to respectively as the top, bottom, left, right, front, and rear sides of the image-reading device 1.

As shown in FIG. 1, the casing 10 includes a first casing 11, and a second casing 12. Both the first casing 11 and second casing 12 have a box-like shape. In FIG. 2, the second casing 12 is excluded from the casing 10 and is not shown.

As shown in FIG. 2, the first casing 11 has a top surface 11A. The top surface 11A slopes downward from the rear side toward the front side. The first casing 11 pivotably supports a bottom edge of the second casing 12 at both left and right sides on the bottom edge of the top surface 11A. In other words, the second casing 12 can pivotally move, along its bottom edge, between a closed position shown in FIG. 1 and an open position (not shown) about a virtual line (not shown) extending in the left-right direction.

The first casing 11 mainly includes a support member 11B, a set guide 86, a feed roller 41, a conveying roller 91, a conveying roller 92 and an image reader 93. The support member 11B constitutes a left-right center and rearward portion of the top surface 11A. The support member 11B is disposed around the feed roller 41 and set guides 86. The set guide 86 will be described later.

In the following description, a virtual line extending along the top surface 11A and passing through the left-right center of the same will be called a centerline 11C. Unless otherwise specified, clockwise and counterclockwise directions will indicate rotational directions from a right-side perspective.

As shown in FIG. 2, the feed roller 41 is configured of two feed rollers 411 and 412. The conveying roller 91 is configured of two conveying rollers 911 and 912. The conveying roller 92 is configured of two conveying rollers 921 and 922. In the following description, the feed rollers 411 and 412 may be collectively referred to as the feed roller 41; the conveying rollers 911 and 912 may be collectively referred to as the conveying roller 91, and the conveying rollers 921 and 922 may be collectively referred to as the conveying roller 92. The feed roller 41, conveying roller 91, and conveying roller 92 are arranged along the top surface 11A in order from the upper-rear side to the lower-front side. The feed roller 411, conveying roller 911, and conveying roller 921 are arranged on the left side of the centerline 11C, while the feed roller 412, 912, and conveying roller 922 are arranged on the right side of the centerline 11C.

Figure 3:
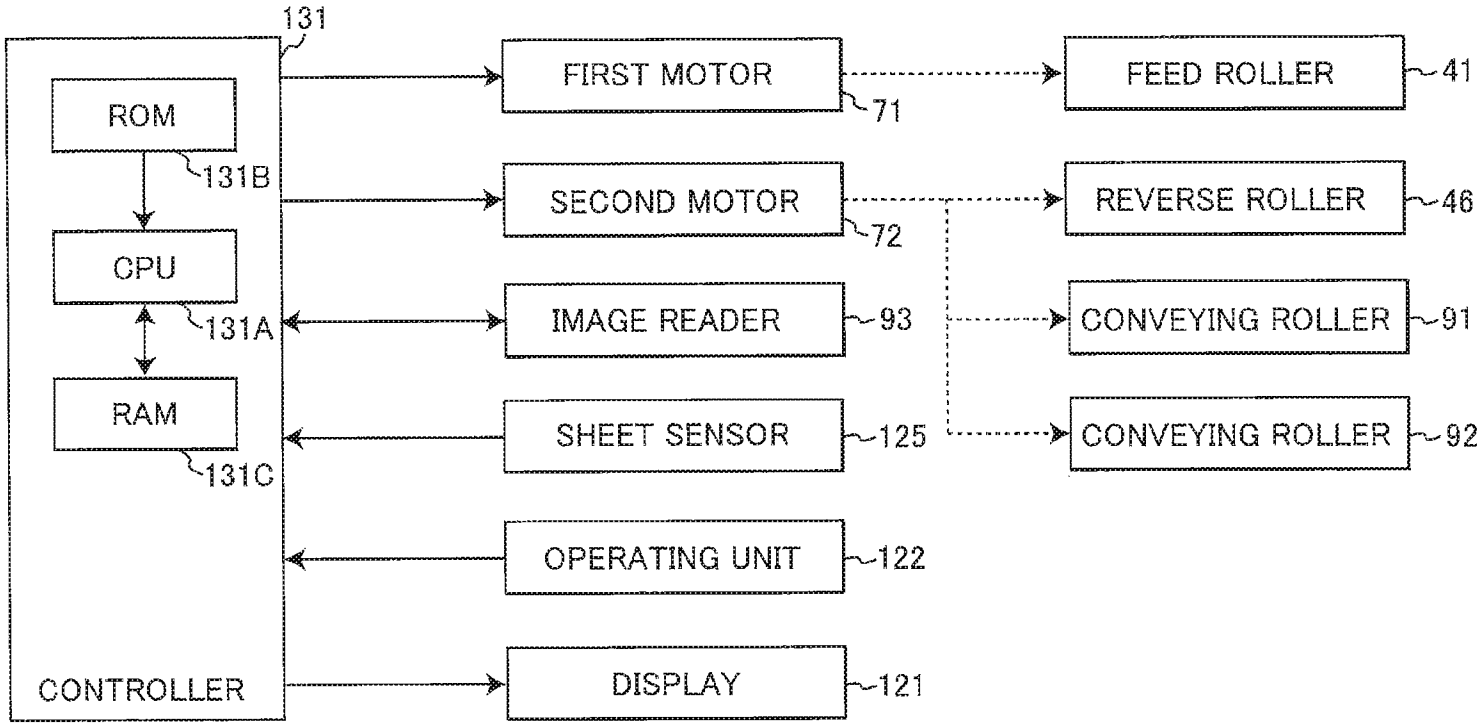
FIG. 3 is a diagram conceptually illustrating functional blocks of the image-reading device 1 according to the embodiment.

The image reader 93 is a contact image sensor well known in the art. The image reader 93 is provided on the top surface 11A of the first casing 11 between the conveying roller 91 and conveying roller 92. The image reader 93 is electrically connected to a controller 131 provided on the second casing 12, as shown in FIG. 3. The image reader 93 is configured to read an image from a sheet as the sheet is conveyed in a feeding direction (i.e., from the upper-rear side toward the lower-front side along the top surface 11A, as shown in FIGS. 1 and 2). The image reader 93 is configured to output data for the image read to the controller 131.

As shown in FIG. 1, the second casing 12 has a top surface 12B constituting an upper surface of the casing 10. A display 121 and operating unit 122 are provided on the top surface 12B. The operating unit 122 includes a plurality of push buttons enabling a user to input instructions into the image-reading device 1. The display 121 and operating unit 122 are electrically connected to the controller 131, as shown in FIG. 3.

The controller 131 is provided on an underside of the second casing 12, i.e., the side opposite the top surface 12B, for example. Referring to FIG. 3, the controller 131 includes a CPU 131A configured to control operations of the image-reading device 1, a ROM 131B for storing programs by which the CPU 131A controls operations of the image-reading device 1, and a RAM 131C for temporarily storing data. The controller 131 is an example of a controller.

Figure 5:
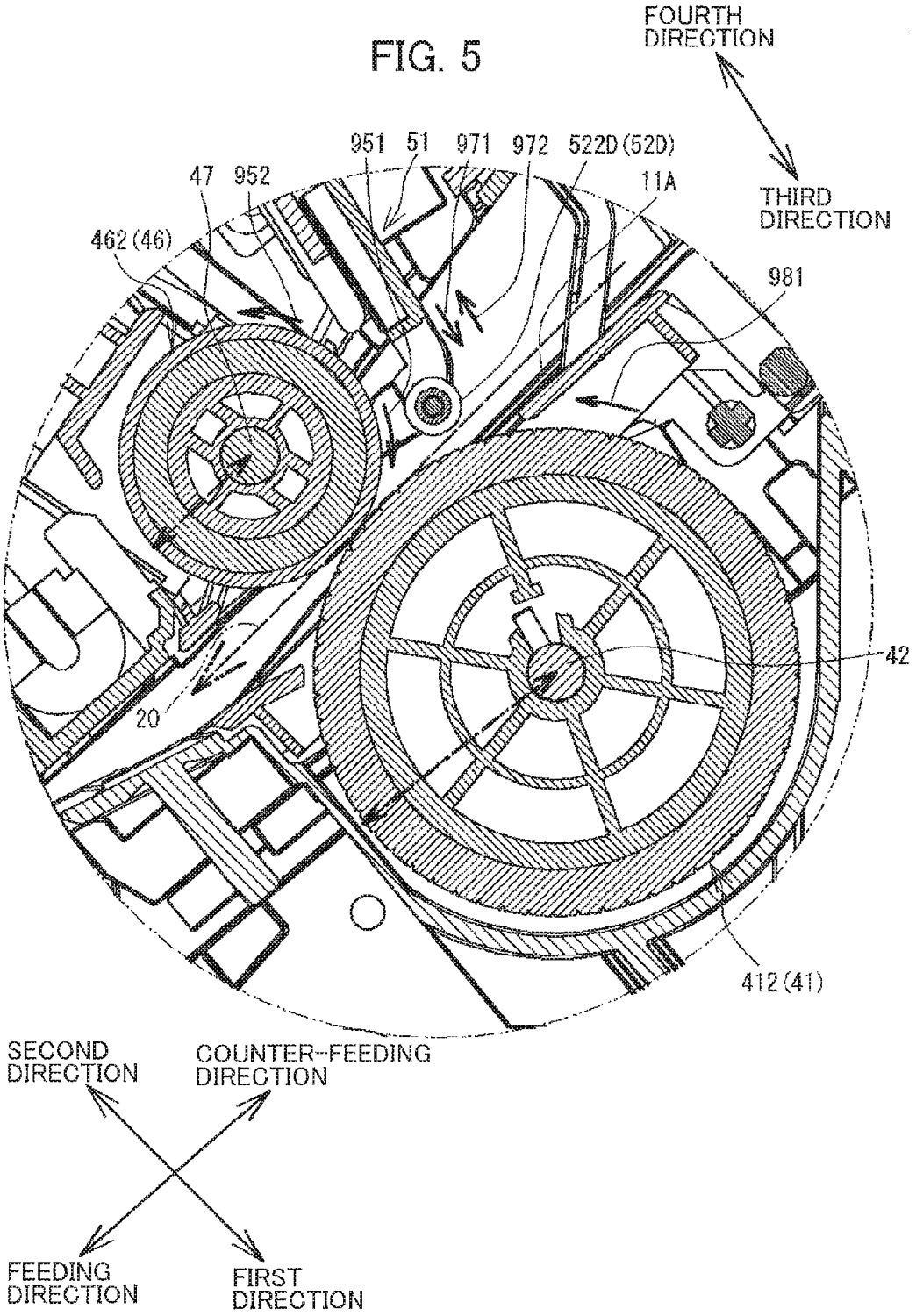
FIG. 5 is a partially-enlarged cross-sectional view showing an essential portion of the image-reading device 1 according to the embodiment, and showing a state of the feed roller 41 and a shaft member 42 when a first operation is performed.

A feed opening 10A is formed in the area between the top edge of the second casing 12 and the top surface 11A, as shown in FIG. 1. A discharge opening 10B is formed in the area between the bottom edge of the second casing 12 and the top surface 11A. Further, a lower surface of the second casing 12 and top surface 11A of the first casing 11 define a conveying path 20 therebetween, as shown in FIGS. 2 and 5. The conveying path 20 communicates with the exterior of the casing 10 through the feed opening 10A and the discharge opening 10B.

As shown in FIGS. 1 and 2, the sheet-feed tray 16 is provided rearward of the casing 10. The sheet-feed tray 16 includes sheet-feeding sections 161, 162, and 163. The sheet-feeding sections 161-163 all have a plate-like shape. The sheet-feeding section 161 extends diagonally upward and rearward from a rear end portion of the first casing 11 to the rear of the feed opening 10A. The sheet-feeding section 161 has an upper surface serving as a tray surface 171. Guides 165 are provided one each on the left and right halves of the tray surface 171. The guides 165 can move in the left-right direction over the tray surface 171. The guides 165 function to center the position of sheets placed on the sheet-feeding section 161 with respect to the left-right direction. The sheet-feeding section 162 extends diagonally upward and rearward from a top edge of the sheet-feeding section 161. The sheet-feeding section 163 extends diagonally upward and rearward from a top edge of the sheet-feeding section 162. The sheet-feeding sections 162 and 163 can move diagonally upward and rearward and diagonally downward and forward.

As shown in FIG. 1, the discharge tray 18 is provided frontward of the casing 10. The discharge tray 18 includes discharge sections 181, 182, and 183. Each of the discharge sections 181-183 has a plate-like shape. The discharge section 181 extends forward from a front end portion of the first casing 11 below the discharge opening 10B. The discharge section 182 extends forward from a front edge of the discharge section 181. The discharge section 183 extends forward from a front edge of the discharge section 182. The discharge sections 181-183 can move in the front-rear direction.

Hereinafter, a direction from the feed opening 10A toward the discharge opening 10B (from the upper-rear side toward the lower-front side from the upper-rear side along the top surface 11A and the lower surface of the second casing 12) is defined as the feeding direction, whereas a direction opposite the feeding direction (i.e., direction from the discharge opening 10B toward the feed opening 10A; from the lower-front side toward the upper-rear side along the top surface 11A and the lower surface of the second casing 12) is defined as a counter-feeding direction. That is, in the image-reading device 1, sheets placed on the sheet-feed tray 16 are configured to be fed into the casing 10 through the feed opening 10A, conveyed along the conveying path 20 within the casing 10, and discharged out of the casing 10 onto the discharge tray 18 through the discharge opening 10B.

2. Detailed Structure of the Casing 10

In addition to the above-described elements such as the feed roller 41 and the conveying rollers 91 and 92, there are also provided a reverse roller 46, a pressing mechanism 50, a cam member 60, a shutter mechanism 80, and a drive mechanism 70 (including a first motor 71 and a second motor 72) in the casing 10.

<Feed Roller 41>

Figure 4:
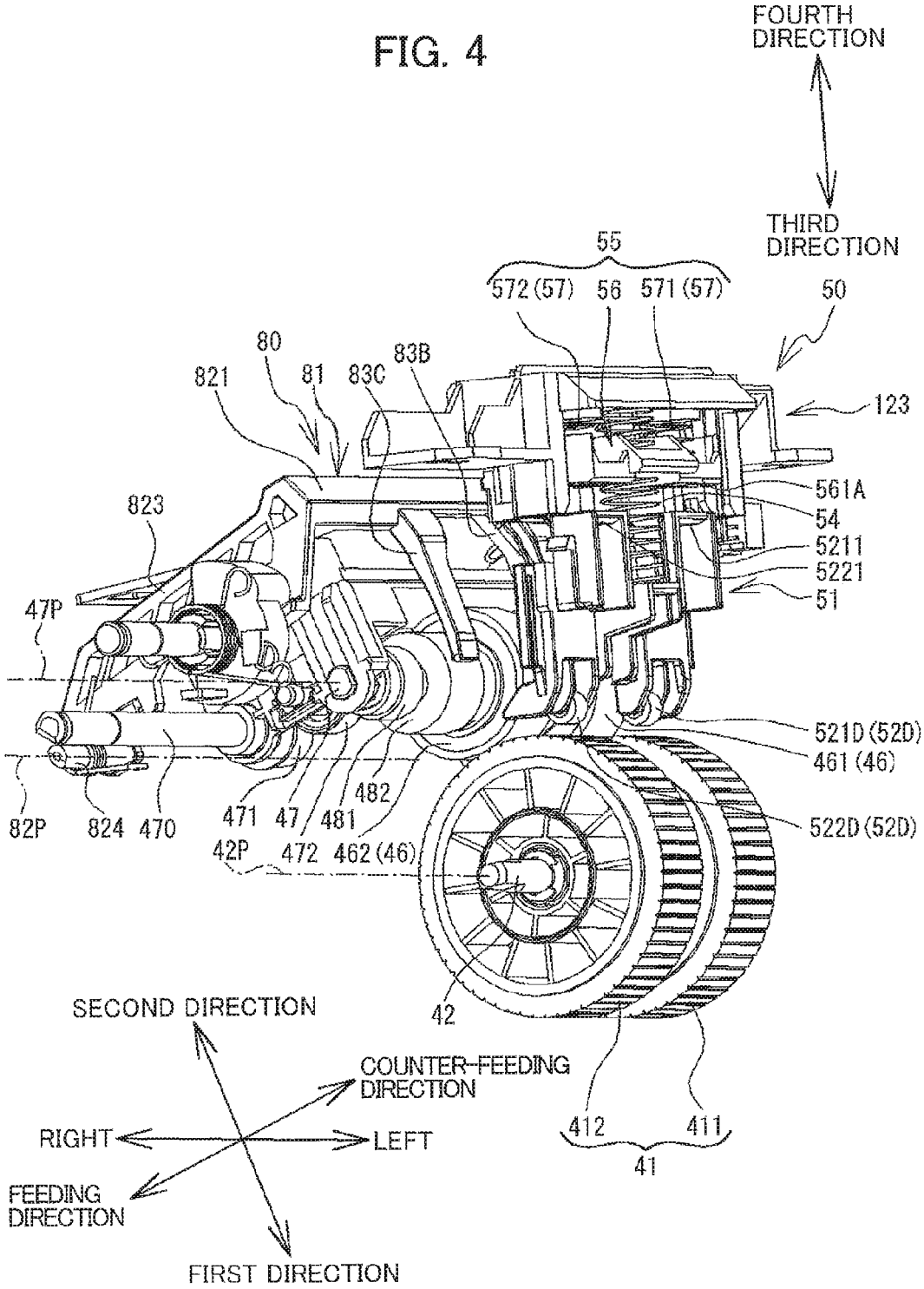
FIG. 4 is a perspective view conceptually explaining positional relationships between a feed roller 41, a reverse roller 46 and a pressing mechanism 50 provided in the image-reading device 1 according to the embodiment.

As shown in FIG. 4, the feed roller 41 is provided in the first casing 11. The feed rollers 411 and 412 respectively define axial directions coincident with the left-right direction. The feed rollers 411 and 412 have substantially the same shape as each other (i.e., substantially circular shape in a side view). As shown in FIGS. 4 and 5, a shaft member 42 serving as a rotational shaft of the feed roller 41 is inserted through a center portion of the feed roller 41 in a right side view. The shaft member 42 is longitudinally oriented in the left-right direction. The shaft member 42 is rotatably supported in the first casing 11. The shaft member 42 is configured to receive a drive force from the first motor 71 and is configured to rotate counterclockwise in a direction indicated by an arrow 981 shown in FIG. 5 upon receipt of the drive force from the first motor 71, which causes the feed roller 41 to rotate in the feeding direction.

Specifically, in response to the rotation of the shaft member 42, the feed roller 41 is configured to rotate in the feeding direction about a virtual line 42P (an imaginary line shown in FIG. 4 that extends in the left-right direction and passes through an axis of the shaft member 42). As shown in FIG. 5, a part of the feed roller 41 protrudes above the top surface 11A of the first casing 11.

<Conveying Rollers 91 and 92>

As shown in FIG. 2, the conveying rollers 91 and 92 are provided in the first casing 11 such that the conveying rollers 91 and 92 respectively define axes oriented in the left-right direction. The conveying rollers 911, 912, 921, and 922 all have substantially the same shape as one another (generally circular shape in a side view).

Figure 6:
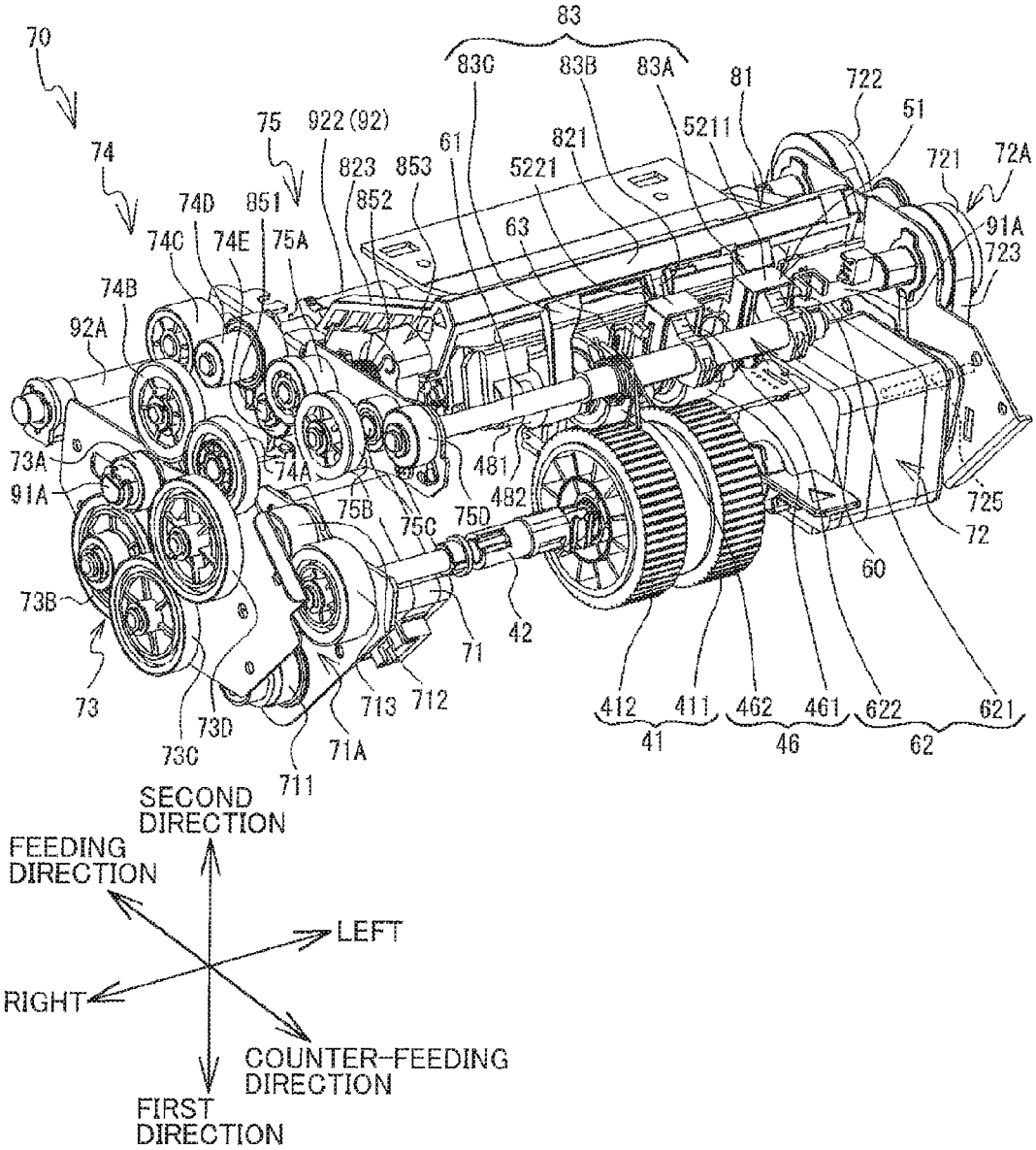
FIG. 6 is a perspective view conceptually illustrating a structure of a drive mechanism 70 provided in the image-reading device 1 according to the embodiment.

Specifically, the conveying roller 91A includes a shaft member 91A extending in the left-right direction, as shown in FIG. 6. The shaft member 91A serves as a rotational shaft of the conveying roller 91. The shaft member 91A is inserted through a center region of the conveying roller 91 in a right side view. Likewise, the conveying roller 92 includes a shaft member 92A extending in the left-right direction and serving as a rotational shaft of the conveying roller 92. The shaft member 92A is inserted through a center region of the conveying roller 92 in a right side view. The conveying rollers 91 and 92 are configured to rotate along with rotation of a drive shaft 725 of the second motor 72 described later. Portions of the respective conveying rollers 91 and 92 protrude through the top surface 11A of the first casing 11 to a position above the top surface 11A.

In the following description, a direction orthogonal to the top surface 11A and from the second casing 12 toward the first casing 11 will be called a first direction, while a direction orthogonal to the top surface 11A and from the first casing 11 toward the second casing 12 will be called a second direction.

<Reverse Roller 46>

The reverse roller 46 is provided in the second casing 12 as an example of a separator. The reverse roller 46 is configured of two reverse rollers 461 and 462. As shown in FIG. 4, the reverse rollers 461 and 462 are provided on the second-direction side of the feed rollers 411 and 412. The reverse rollers 461 and 462 have substantially the same shape as each other (generally circular shape in a side view). In the following description, the reverse rollers 461 and 462 may also be collectively referred to as the reverse roller 46. The reverse roller 46 defines an axis aligned in the left-right direction. The reverse roller 46 has a radius smaller than a radius of the feed roller 41, as shown in FIG. 5.

As shown in FIGS. 4 and 5, the reverse roller 46 includes a shaft member 47 extending in the left-right direction and serving as a rotational shaft of the reverse roller 46. The shaft member 47 is provided to penetrate through a center region of the reverse roller 46 when viewed from the right side. The shaft member 47 is rotatably supported in the second casing 12. As shown in FIG. 4, the reverse roller 46 is connected to the shaft member 47 through a torque limiter 482. A gear 481 is coupled to a right end of the shaft member 47. The shaft member 47 is configured to rotate in response to the rotation of the drive shaft 725 of the second motor 72 described later.

A portion of the reverse roller 46 protrudes downward through the lower surface of the second casing 12. As shown in FIGS. 4 and 5, the reverse rollers 461 and 462 respectively contact the feed rollers 411 and 412. The reverse rollers 461 and 462 are urged by urging members (not shown) to be in contact with and pressed against the feed rollers 411 and 412. The conveying path 20 formed by the lower surface of the second casing 12 and top surface 11A of the first casing 11 is specifically defined between the reverse roller 46 and feed roller 41, as shown in FIG. 5. The reverse roller 46 is configured to rotate about a virtual line 47P (an imaginary line shown in FIG. 4 that extends in the left-right direction through a center of the shaft member 47) in response to the rotation of the shaft member 47. The reverse roller 46 can rotate both in the feeding direction and in the counter-feeding direction opposite the feeding direction by the drive force of the second motor 72.

<Pressing Mechanism 50>

The pressing mechanism 50 is provided in the second casing 12. Specifically, as shown in FIG. 4, the pressing mechanism 50 is disposed in on the sides of the reverse roller 46 facing in the counter-feeding direction and the second direction (hereinafter also referred to as the "counter-feeding-direction side" and the "second-direction side").

Further, in the following description, a direction in which the pressing mechanism 50 extends toward the feed roller 41 will be called a third direction, while a direction opposite the third direction will be called a fourth direction.

The pressing mechanism 50 is supported in the second casing 12 through a support member 123. The pressing mechanism 50 includes a pressing member 51, a first spring 54, and an urging unit 55. The pressing member 51 extends through the second casing 12 toward the feed roller 41. The support member 123 supports the pressing member 51 so that the pressing member 51 can move in both the third and fourth directions. The pressing member 51 can oppose the feed roller 41 with the conveying path 20 interposed therebetween.

The pressing member 51 has an end portion on the third-direction side on which a pressure roller 52D is provided. Specifically, the pressure roller 52D is configured of the pressure rollers 521D and 522D. The pressure rollers 521D and 522D are provided respectively on left and right ends of the third-direction side end portion of the pressing member 51. The pressure rollers 521D and 522D respectively define axes aligned in the left-right direction. The left-right centers of the pressure rollers 521D and 522D are substantially aligned with the respective left-right centers of the feed rollers 411 and 412. In the following description, the pressure rollers 521D and 522D may also be collectively referred to as the pressure roller 52D.

The pressing member 51 also includes plate-shaped parts 5211 and 5221 extending in the left-right direction. The plate-shaped parts 5211 and 5221 are provided on an end portion of the pressing member 51 on the fourth-direction side. More specifically, the plate-shaped parts 5211 and 5221 are respectively provided on left and right ends of the fourth-direction side end portion of the pressing member 51.

The first spring 54 and urging unit 55 are provided at the fourth-direction side of the pressing member 51 and the third-direction side of the support member 123. The first spring 54 urges a left-right center portion of the pressing member 51 between the plate-shaped parts 5211 and 5221 to urge the pressing member 51 in the third direction. The urging unit 55 includes an intermediate member 56, and a second spring 57 configured of second springs 571 and 572. In the following description, the second springs 571 and 572 may be collectively referred to as the second spring 57.

The intermediate member 56 has a plate-shaped part 561A occupying a plane aligned in the left-right direction. A hole (not shown) is formed in a left-right center region of the plate-shaped part 561A and penetrates the same in the third direction. The first spring 54 is inserted through this hole in the plate-shaped part 561A to be disposed between the support member 123 and the left-right center portion of the pressing member 51.

The second springs 571 and 572 are disposed to extend in the third direction. The second spring 57 (second springs 571 and 572) is interposed between the support member 123 and the intermediate member 56 in the third direction and fourth direction. Specifically, third-direction side ends of the second springs 571 and 572 are respectively disposed on left and right ends of the plate-shaped part 561A constituting the intermediate member 56. Fourth-direction side ends of the second springs 571 and 572 are respectively supported by the support member 123. The second spring 57 thus urges the intermediate member 56 in the third direction. When urged by the second spring 57, the intermediate member 56 in turn urges the pressing member 51 in the third direction. Hence, the pressing member 51 is urged in the third direction by the urging forces of the first spring 54 and second spring 57 (second springs 571 and 572).

<Cam Member 60>

The cam member 60 is rotatably supported in the second casing 12. Specifically, the cam member 60 is provided on the counter-feeding-direction side of the pressing mechanism 50. As shown in FIG. 6, the cam member 60 includes a shaft member 61, cams 621 and 622, and a spring 63. The shaft member 61 extends in the left-right direction. The shaft member 61 is disposed on the counter-feeding-direction side of the pressing mechanism 50. The shaft member 61 is configured to rotate in response to the rotation of the drive shaft 725 in the second motor 72.

The cams 621 and 622 are provided on the shaft member 61. The cams 621 and 622 have the same shape as each other. In the following description, the cams 621 and 622 will also be collectively referred to as a cam 62. The cam 62 is arranged on the counter-feeding-direction side of the pressing mechanism 50. The cam 62 is a plate cam and protrudes in the feeding direction from the shaft member 61. In accordance with rotation of the shaft member 61, the cams 621 and 622 can contact and separate from the plate-shaped parts 5211 and 5221 of the pressing member 51 constituting the pressing mechanism 50.

The spring 63 is wound about the shaft member 61 at a position farther rightward of the cam 621. The spring 63 urges the shaft member 61 to rotate in the counterclockwise direction.

The pressing member 51 is movable between a pressing position and a retracted position by the functions of the cam member 60, the urging unit 55 and the first spring 54. In the pressing position, the pressure roller 52D of the pressing member 51 protrudes in the first direction from the lower surface of the second casing 12. That is, the pressure roller 52D (a portion of the pressing member 51) is capable of pressing the sheets toward the feed roller 41. In the retracted position, the pressure roller 52D is positioned inside the second casing 12. That is, the pressure roller 52D (a portion of the pressing member 51) is retracted from the conveying path 20. The operations for moving the pressing member 51 will be described later.

<Shutter Mechanism 80>

Figure 7:
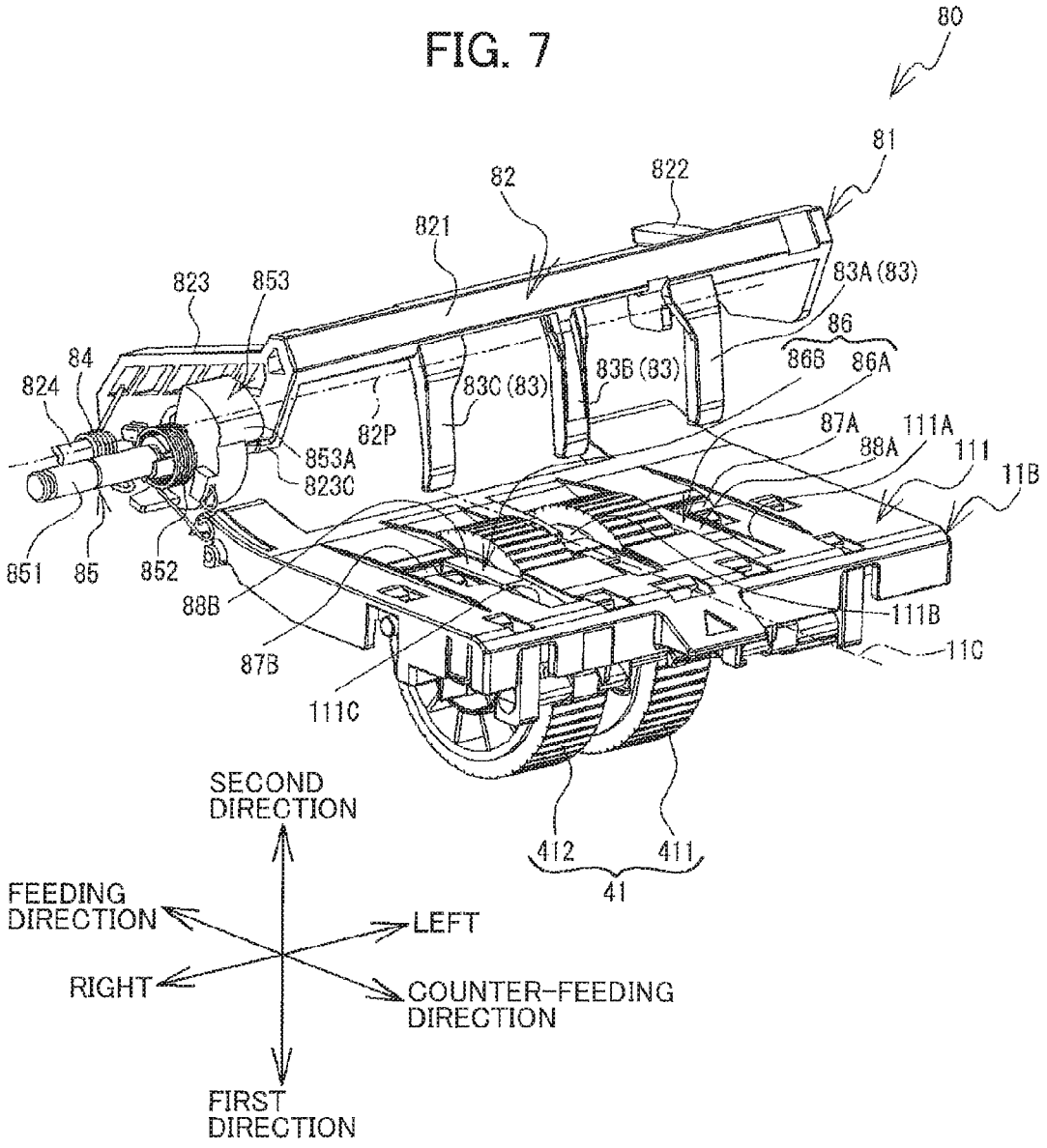
FIG. 7 is a perspective view conceptually illustrating a shutter mechanism 80 provided in the image-reading device 1 according to the embodiment, wherein a shutter 81 of the shutter mechanism 80 is at a non-restricting position.
Figure 8A:
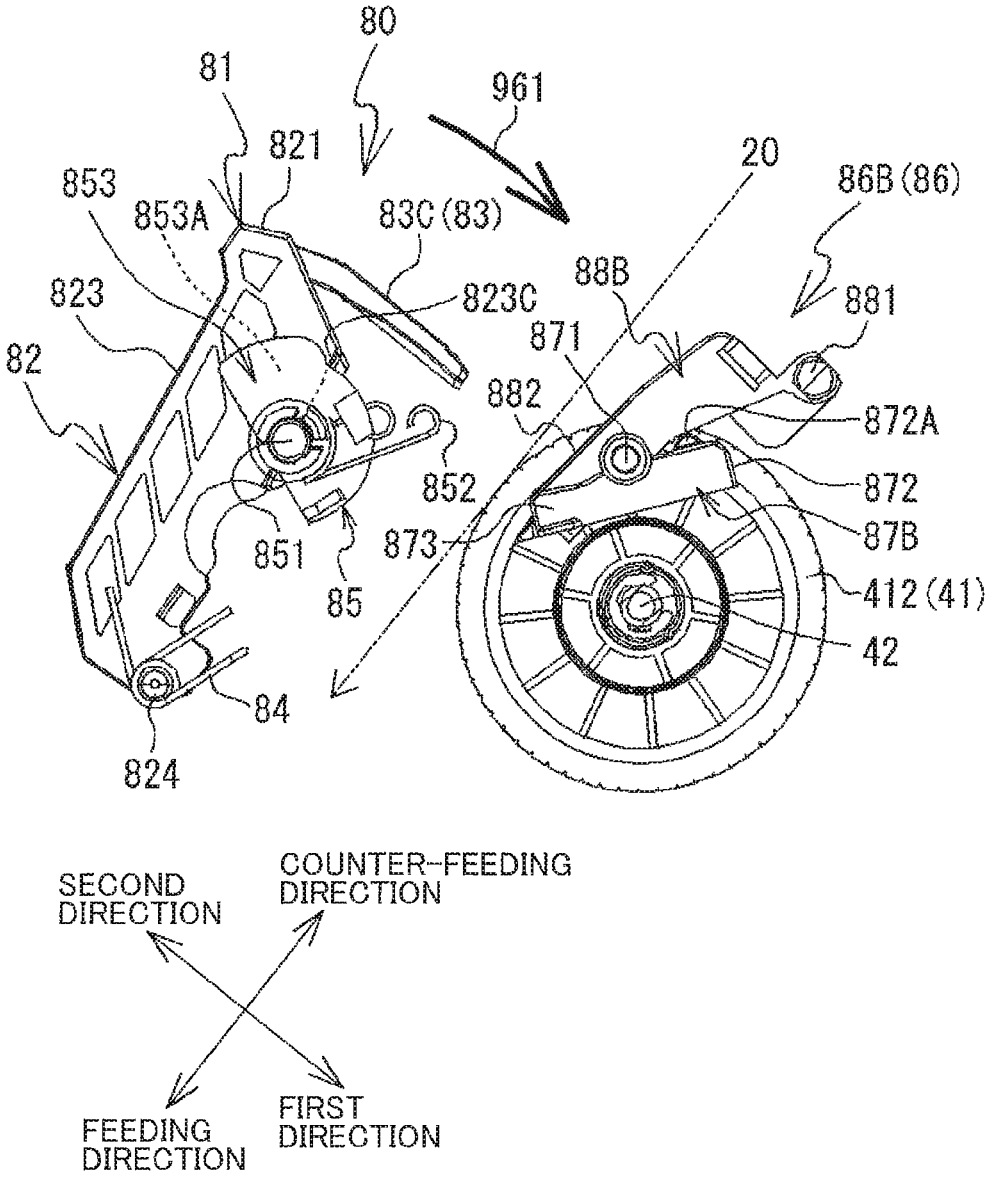
FIG. 8A is a side view explaining a movement of the shutter 81 of the shutter mechanism 80 at the non-restricting position.
Figure 8B:
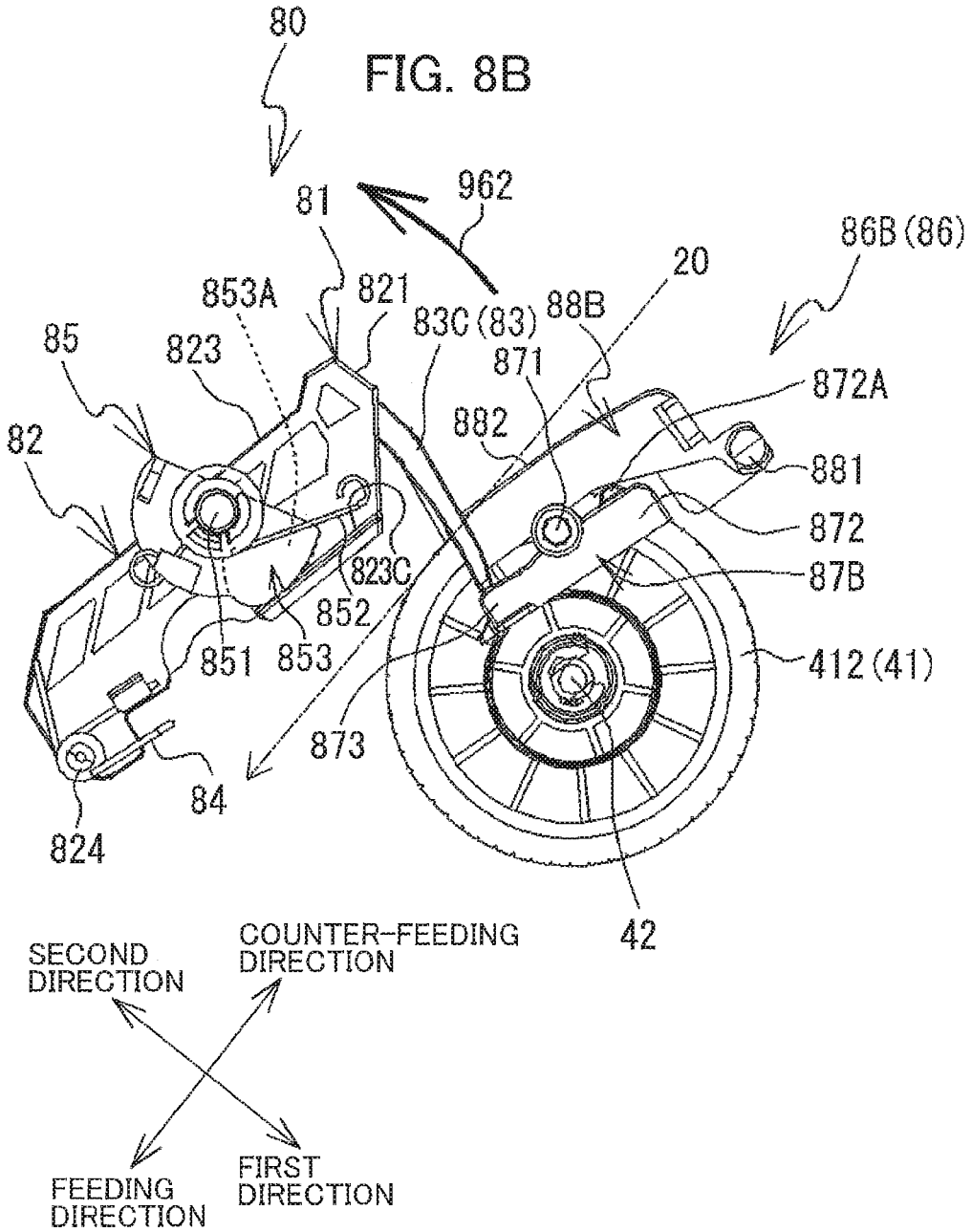
FIG. 8B is a side view explaining the movement of the shutter 81 of the shutter mechanism 80 at a restricting position.

As shown in FIG. 4, the shutter mechanism 80 is provided on the feeding-direction side of the pressing mechanism 50. As shown in FIGS. 7 to 8B, the shutter mechanism 80 includes a shutter 81, a driven portion 85, and the set guide 86. The shutter 81 and driven portion 85 are provided in the second casing 12, while the set guide 86 is provided in the first casing 11.

As shown in FIG. 7, the shutter 81 includes a support member 82, an extension member 83, and a spring 84 as an example of an urging member. The support member 82 has a first portion 821, and second portions 822 and 823. The first portion 821 and second portions 822 and 823 are all disposed in the second casing 12. The first portion 821 is a bar-shaped member that extends in the left-right direction. The second portion 822 extends in the feeding direction from a left end of the first portion 821. The second portion 823 extends in the feeding direction from a right end of the first portion 821.

Shaft parts 824 are respectively provided on feeding-direction side ends of the second portions 822 and 823 to protrude outward therefrom in the left-right direction. Note that only the right shaft part 824 is shown in FIGS. 7 through 8B. The shaft parts 824 are rotatably supported in the second casing 12. The shutter 81 is configured to pivotally move about a virtual line 82P which is an imaginary straight line extending through the shaft parts 824 in the left-right direction.

The spring 84 is wound about the shaft part 824 on the second portion 823 side (i.e., on the right shaft part 824). The spring 84 is a coil spring. The spring 84 has one end fixed to the second portion 823, and another end fixed to the second casing 12. The spring 84 urges the support member 82 to pivotally move in the counterclockwise direction. The second portion 823 has an end portion on the counter-feeding-direction side at which a protruding part 823C is provided. The protruding part 823C protrudes rightward from the counter-feeding-direction side end portion of the second portion 823. The protruding part 823C has a plate-like shape and extends along an edge of the second portion 823 that faces in the first direction.

The extension member 83 is configured of extension parts 83A, 83B, and 83C. The extension part 83A, 83B, and 83C all extend in the first direction from the support member 82. The extension part 83B is disposed between the feed rollers 411 and 412 in the left-right direction. The extension part 83A is arranged on the left side of the feed roller 411, while the extension part 83C is arranged on the right side of the feed roller 412.

The driven portion 85 includes a shaft member 851, a spring 852, and a cam 853. The shaft member 851 is disposed rightward of the second portion 823 constituting the support member 82. The shaft member 851 extends in the left-right direction and is rotatably supported in the second casing 12. The shaft member 851 is configured to rotate in accordance with the rotation of the second motor 72. The shaft member 851 is an example of a supporting member.

The cam 853 is provided on a left end of the shaft member 851. The cam 853 is a plate cam having a semicircular shape. The cam 853 is thus pivotally movable along with the rotation of the shaft member 851. The spring 852 is wound about the shaft member 851 and is positioned to the right of the cam 853. The spring 852 is a coil spring. The spring 852 has one end fixed to the cam 853, and another end fixed to the second casing 12. The spring 852 urges the shaft member 851 to rotate in the counterclockwise direction.

The cam 853 has a left surface on which a protruding part 853A is formed. As shown in FIG. 8A, the protruding part 853A has a general fan shape with a central angle of approximately 60 degrees. The protruding part 853A is configured to contact a surface of the protruding part 823C that faces in the second direction. The protruding part 853A is pivotally movable along with the pivotal movement of the cam 853. The shutter 81 is movable between a non-restricting position shown in FIG. 8A and a restricting position shown in FIG. 8B by the functions of the cam 853 and spring 852. In the restricting position, the extension member 83 (extension parts 83A, 83B, and 83C) of the shutter 81 extends across the conveying path 20 from the second-direction side toward the first-direction side. In this restricting position, the leading edges of sheets placed in the sheet-feed tray 16 are in contact with the extension member 83 to be restricted by the extension member 83. In the non-restricting position, the extension member 83 (extension parts 83A, 83B, and 83C) is retracted from the conveying path 20 in the second direction. In this non-restricting position, the extension member 83 no longer restricts the leading edges of the sheets in the sheet-feed tray 16. The operations for moving the shutter 81 between the restricting position and non-restricting position will be described later.

Next, the set guide 86 will be described. As shown in FIG. 7, the support member 11B is arranged around the feed roller 41. The support member 11B has a surface 111 facing in the second direction that forms part of the top surface 11A (left-right center and rearward portion of the top surface 11A), as shown in FIG. 2. Openings 111A, 111B, and 111C are formed in the surface 111 of the support member 11B. The opening 111A is formed to the left of the centerline 11C; the opening 111C is formed to the right of the centerline 11C; and the opening 111B is formed along the centerline 11C. The support member 11B supports the set guide 86 on the first-direction side of the surface 111.

The set guide 86 includes set guides 86A and 86B. The set guide 86A is disposed leftward of the feed roller 411, while the set guide 86B is disposed rightward of the feed roller 412. The set guides 86A and 86B have symmetrical shapes with respect to the left-right direction. For this reason, only the set guide 86B will be described in detail below, while a description of the set guide 86A will be simplified.

As shown in FIGS. 8A and 8B, the set guide 86B includes a first member 87B, and a second member 88B. The first member 87B and second member 88B extend in the feeding direction. The first member 87B is disposed on the right side of the second member 88B. The first member 87B has a center portion in the feeding direction on which a shaft part 871 is provided. The shaft part 871 is oriented in the left-right direction and is rotatably supported in the first casing 11. The first member 87B can pivot about the shaft part 871. The first member 87B has an end portion 872 on the counter-feeding-direction side that extends leftward and advances beneath the second member 88B. On the end portion 872, a protruding part 872A is provided to protrude upward therefrom. The protruding part 872A is in contact with a bottom surface of the second member 88B.

The second member 88B has an end portion in the counter-feeding direction on which a shaft part 881 is provided. The shaft part 881 extends in the left-right direction. The shaft part 881 is also positioned downstream of the first member 87B in the counter-feeding direction. The shaft part 881 is rotatably supported in the first casing 11. The second member 88B can thus pivotally move about the shaft part 881. The second member 88B is supported from below by the protruding part 872A of the first member 87B. As shown in FIG. 7, portions of the first member 87B and second member 88B are exposed through the opening 111C. The second member 88B has a surface 882 facing in the second direction (hereinafter, called "second-direction-side surface 882").

Likewise, as shown in FIG. 7, the set guide 86A includes a first member 87A, and a second member 88A. The first member 87A and second member 88B correspond to the first member 87B and second member 88B of the set guide 86B. Portions of the first member 87A and second member 88A are exposed through the opening 111A. When the shutter 81 moves to the restricting position, the set guide 86 moves to a first guiding position shown in FIG. 8B. When the shutter 81 moves to the non-restricting position, the set guide 86 moves to a second guiding position shown in FIG. 8A. The operations for moving the set guide 86 will be described later.

<Drive Mechanism 70>

As shown in FIG. 6, the drive mechanism 70 includes the first motor 71, the second motor 72, and transmission mechanisms 71A, 72A, 73, 74, and 75. The first motor 71, second motor 72, and transmission mechanisms 71A, 72A, and 73 are provided in the first casing 11, while the transmission mechanisms 74 and 75 are provided in the second casing 12.

The first motor 71 is provided in a right end portion of the first casing 11. The first motor 71 has a drive shaft (not shown) that extends in the left-right direction (rightward). The transmission mechanism 71A includes gears 711, 712, 713; a belt (not shown); and the shaft member 42. The gears 711, 712, and 713 and the belt are disposed on the right side of the first motor 71, and are configured to rotate when the drive shaft of the first motor 71 is driven to rotate. The gear 713 is connected to a right end of the shaft member 42. The transmission mechanism 71A is thus configured to transmit the drive force of the first motor 71 to the feed roller 41. That is, the transmission mechanism 71A can transmit the drive force for rotating the feed roller 41 in the feeding direction.

The second motor 72 is provided in a left end portion of the first casing 11. The second motor 72 has the drive shaft 725 that extends in the left-right direction (leftward). As will be described later, when the drive shaft 725 rotates in a forward direction, the conveying roller 91 rotates in the counter-feeding direction while the reverse roller 46 rotates in the feeding direction. Conversely, when the drive shaft 725 rotates in a reverse direction, the conveying rollers 91 and 92 rotate in the feeding direction while the reverse roller 46 rotates in the counter-feeding direction.

The transmission mechanism 72A is disposed on the left side of the second motor 72. The transmission mechanism 72A includes gears 721 and 722, and a belt 723. The belt 723 is mounted over the gears 721 and 722 to be looped around the same. The gears 721 and 722, and the belt 723 are configured to rotate when the drive shaft 725 of the second motor 72 rotates.

The gear 721 is connected to a left end of the shaft member 91A of the conveying roller 91. The gear 722 is connected to a left end of the shaft member 92A of the conveying roller 92. The transmission mechanism 72A can thus transmit a drive force of the second motor 72 to the shaft member 91A and shaft member 92A. That is, the conveying rollers 91 and 92 can rotate in response to the rotation of the second motor 72.

The gear 722 includes an internal one-way clutch. When the second motor 72 rotates in the reverse direction, the one-way clutch of the gear 722 transmits the drive force of the second motor 72 to the shaft member 92A, causing the conveying roller 92 to rotate in the counterclockwise direction, i.e., the feeding direction. However, when the second motor 72 rotates in the forward direction, the one-way clutch of the gear 722 allows the shaft member 92A to freewheel relative to the gear 722. Hence, in this case, the drive force of the second motor 72 is not transmitted to the conveying roller 92.

On the other hand, the gear 721 does not possess a one-way clutch. Accordingly, when the second motor 72 rotates in the reverse direction, the gear 721 can transmit the drive force of the second motor 72 to the shaft member 91A, causing the conveying roller 91 to rotate counterclockwise, i.e., in the feeding direction. When the second motor 72 rotates in the forward direction, the gear 721 transmits the drive force of the second motor 72 to the shaft member 91A, causing the conveying roller 91 to rotate clockwise, i.e., in the counter-feeding direction.

The transmission mechanism 72A can thus transmit the drive force of the second motor 72 to the conveying rollers 91 and 92.

The transmission mechanism 73 includes gears 73A, 73B, 73C, and 73D. The gear 73A is engaged with the gear 73B, the gear 73B with the gear 73C, and the gear 73C with the gear 73D. The gear 73A is coupled to the right end of the shaft member 91A in the conveying roller 91. The gears 73A, 73B, 73C, and 73D can rotate in response to the rotation of the shaft member 91A. The transmission mechanism 73 can transmit the drive force of the second motor 72, which is transmitted from the shaft member 91A, to the transmission mechanism 74.

The transmission mechanism 74 includes gears 74A, 74B, 74C, 74D, 74E, the gears 471, 472, and 481; and the torque limiter 482. The gear 74A is configured to be engaged with the gear 73D of the transmission mechanism 73 when the second casing 12 is placed in the closed position shown in FIG. 1. The gear 74A is configured to be separated from the gear 73D of the transmission mechanism 73 when the second casing 12 is rotated to its open position (not shown). The following description will be based on the second casing 12 being in its closed position. The gear 74A is engaged with the gear 74B, the gear 74B with the gear 74C, the gear 74C with the gear 74D, and the gear 74D with the gear 74E. As shown in FIG. 4, the gear 471 is engaged with the gear 472, and the gear 472 with the gear 481. The gear 481 is coupled to the shaft member 47 which is connected to the reverse roller 46 through the torque limiter 482, as described earlier. The gear 471 has a rotational shaft 470 that extends rightward therefrom and is connected to a gear (not shown) included in the transmission mechanism 74.

The gear 74B is connected to the shaft member 47 of the reverse roller 46 via gears (not shown) included in the transmission mechanism 74; the gears 471, 472, and 481; and the torque limiter 482. That is, the drive force of the second motor 72 can be transmitted to the reverse roller 46 via the transmission mechanism 72A; shaft member 91A; transmission mechanism 73; gears 74A, 74B, 471, 472 and 481; and torque limiter 482.

When the drive shaft 725 of the second motor 72 rotates in the reverse direction, the drive force of the second motor 72 is transmitted to the shaft member 47, causing the reverse roller 46 to rotate counterclockwise, i.e., in the counter-feeding direction. When the drive shaft 725 of the second motor 72 rotates in the forward direction, the drive force of the second motor 72 is transmitted to the shaft member 47, causing the reverse roller 46 to rotate clockwise, i.e., in the feeding direction.

The torque limiter 482 is configured to connect the shaft member 47 and reverse roller 46 when a rotational torque applied to the reverse roller 46 is within a prescribed threshold value. The torque limiter 482 is configured to disconnect the shaft member 47 and reverse roller 46 when the rotational torque applied to the reverse roller 46 exceeds the prescribed threshold value.

The gear 74E is connected to the shaft member 851 of the driven portion 85 shown in FIG. 7. Thus, the drive force of the second motor 72 can be transmitted to the driven portion 85 via the transmission mechanism 72A, shaft member 91A, and transmission mechanisms 73 and 74. The gear 74E has an internal one-way clutch. When the second motor 72 rotates in the forward direction, the one-way clutch of the gear 74E is configured to transmit the drive force of the second motor 72 to the shaft member 851, causing the cam 853 to pivot clockwise. However, when the second motor 72 rotates in the reverse direction, the one-way clutch of the gear 74E allows the shaft member 851 to freewheel relative to the gear 74E. In this case, the drive force of the second motor 72 is not transmitted to the cam 853.

The transmission mechanism 74 can transmit the drive force of the second motor 72, which is transmitted from the transmission mechanism 73, to the reverse roller 46 and driven portion 85 of the shutter 81.

The transmission mechanism 75 includes gears 75A, 75B, 75C, and 75D. The gear 74E of the transmission mechanism 74 is engaged with the gear 75A, the gear 75A with the gear 75B, the gear 75B with the gear 75C, and the gear 75C with the gear 75D.

The gear 75D is connected to the shaft member 61 of the cam member 60. The drive force of the second motor 72 can be thus transmitted to the cam member 60 via the transmission mechanism 72A, the shaft member 91A, and the transmission mechanisms 73, 74, and 75. The gear 75D has an internal one-way clutch. When the drive shaft 725 of the second motor 72 rotates in the forward direction, the one-way clutch of the gear 75D is configured to transmit the drive force of the second motor 72 to the shaft member 61, causing the cam 62 to rotate clockwise. However, when the drive shaft 725 of the second motor 72 rotates in the reverse direction, the one-way clutch of the gear 75D allows the shaft member 61 to freewheel relative to the gear 75D. In this case, the drive force of the second motor 72 is not transmitted to the cam 62.

3. Operations of the Image-Reading Device 1

Next, processes executed by the controller 131 of the image-reading device 1 will be described with reference to the flowchart of FIG. 9.

When the power to the image-reading device 1 is turned on, the CPU 131A of the controller 131 is configured to read a control program from the ROM 131B and develop the program in the RAM 131C. The CPU 131A of the controller 131 is configured to execute processes based on this control program to enable the controller 131 to control the image-reading device 1.

<Preliminary Operation>

First, the CPU 131A is configured to execute a preliminary operation in S1. In this preliminary operation, the CPU 131A controls the drive shaft 725 of the second motor 72 to rotate in the forward direction, thereby placing the shutter 81 in the restricting position, the set guide 86 in the first guiding position, and the pressing member 51 in the retracted position. Also, since the drive shaft 725 of the second motor 72 is rotated in the forward direction, the reverse roller 46 rotates in the feeding direction, and the conveying roller 91 rotates in the counter-feeding direction, but the conveying roller 92 does not rotate.

Specifically, in S1, the CPU 131A rotates the drive shaft 725 of the second motor 72 in the forward direction. The drive force of the second motor 72 is transmitted to the gear 74E via the transmission mechanism 72A, shaft member 91A, transmission mechanism 73, and gears 74A-74D in the transmission mechanism 74. In response to the rotation of the drive shaft 725 of the second motor 72 in the forward direction, the one-way clutch of the gear 74E transmits the drive force of the second motor 72 to the shaft member 851 of the driven portion 85. Accordingly, the cam 853 of the driven portion 85 is caused to pivot clockwise against the urging force of the spring 852.

When the cam 853 pivots clockwise, the protruding part 853A of the cam 853 presses the protruding part 823C of the second portion 823, forcing the support member 82 of the shutter 81 to pivot clockwise against the urging force of the spring 84, as indicated by an arrow 961 in FIG. 8A. Thus, the shutter 81 is set in its restricting position as shown in FIG. 8B. In the restricting position, the extension parts 83A, 83B, and 83C lay across the conveying path 20 from the second-direction side toward the first-direction side. That is, the extension member 83 (a portion of the shutter 81) crosses the conveying path 20. The extension parts 83A and 83C press downward on feeding-direction-side ends 873 of the first members 87A and 87B constituting set guides 86A and 86B, respectively. Consequently, the first members 87A and 87B are pivotally moved counterclockwise about the respective shaft parts 871, causing the protruding parts 872A of first members 87A and 87B to push the second members 88A and 88B upward. The second members 88A and 88B are thus pivotally moved clockwise about the respective shaft parts 881, causing feeding-direction-side ends of the second members 88A and 88B to move in the second direction. Hence, feeding-direction-side ends on the second-direction-side surfaces 882 of the second members 88A and 88B are positioned further downstream of the feed roller 41 in the second direction. That is, the set guide 86 is placed in the first guiding position.

In the meantime, the drive force of the second motor 72 is also transmitted to the gear 75D via the transmission mechanism 72A, shaft member 91A, transmission mechanisms 73 and 74, and gears 75A-75C. In response to the rotation of the drive shaft 725 of the second motor 72 in the forward direction, the one-way clutch of the gear 75D transmits the drive force of the second motor 72 to the shaft member 61 of the cam member 60. Accordingly, the shaft member 61 is rotated clockwise against the urging force of the spring 63 to pivotally move the cam 62 clockwise.

When the cam 62 pivots clockwise, the cams 621 and 622 are respectively brought into contact with the bottoms surfaces of the plate-shaped parts 5211 and 5221 of the pressing member 51. As the cam 62 pivots, a force in the fourth direction is applied to the pressing member 51. Consequently, the pressing member 51 is moved in the fourth direction, as indicated by an arrow 972 in FIG. 5, against the urging forces of the first spring 54 and urging unit 55 until arriving at the retracted position. In the retracted position, the pressing member 51 is positioned farther in the fourth direction than the lower surface of the second casing 12. The pressure roller 52D (pressure rollers 521D and 522D) does not protrude from the lower surface of the second casing 12 into the conveying path 20 at this time. That is, the pressure roller 52D (pressing member 51) is retracted from the conveying path 20.

When the drive shaft 725 of the second motor 72 rotates in the forward direction, the one-way clutch of the gear 722 in the transmission mechanism 72A allows the shaft member 92A to freewheel. Consequently, the drive force of the second motor 72 is not transmitted to the shaft member 92A and, hence, the conveying roller 92 does not rotate. However, the gear 721 of the transmission mechanism 72A rotates the shaft member 91A clockwise when the drive shaft 725 of the second motor 72 rotates in the forward direction. Accordingly, the drive force of the second motor 72 is transmitted to the shaft member 91A, rotating the conveying roller 91 in the counter-feeding direction.

The drive force of the second motor 72 is also transmitted to the shaft member 47 via the transmission mechanism 72A, shaft member 91A, transmission mechanism 73, gears 74A and 74B of the transmission mechanism 74, and gears 471, 472, and 481. Consequently, the drive force of the second motor 72 is transmitted to the reverse roller 46, thereby rotating the reverse roller 46 in the feeding direction indicated by an arrow 951 in FIG. 5.

After the preliminary operation is executed in S1 as described above, the user next places a plurality of sheets in the sheet-feed tray 16. Edges of the sheets positioned downstream in the feeding direction (i.e., leading edges of the sheets) enter into the feed opening 10A. Once the sheets have been placed in the sheet-feed tray 16, a sheet sensor 125 (refer to FIG. 3) is configured to detect the sheets and transmit a detection signal to the controller 131. As a result, the CPU 131A of the controller 131 can detect that sheets are present in the sheet-feed tray 16.

At this time, the pressing member 51 is in the retracted position as a result of the preliminary operation. Consequently, the sheets entering the conveying path 20 are not in contact with the pressure roller 52D of the pressing member 51. As shown in FIG. 8B, the feeding-direction ends of the second-direction-side surfaces 882 on the second members 88A and 88B constituting the set guide 86 are positioned on the second direction side relative to the conveying path 20. Accordingly, the sheets contact the second-direction-side surfaces 882 on the second members 88A and 88B rather than contacting the feed roller 41. Further, the shutter 81 is in the restricting position, whereby the extension member 83 crosses the conveying path 20 at a position further downstream in the counter-feeding direction than the point of contact between the feed roller 41 and reverse roller 46. Thus, the extension member 83 can restrict the sheets from moving in the feeding direction, thereby preventing the sheets from reaching the point of contact between the feed roller 41 and reverse roller 46.

In this state, if the user operates the operating unit 122 shown in FIG. 1 and the CPU 131A detects input of a read command to begin a reading process (S2: YES), the CPU 131A is configured to execute a first feeding process in S3. However, while the CPU 131A does not detect a read command in S2 (S2: NO), the CPU 131A is configured to continue to loop back to S2.

<First Feeding Process>

Next, the first feeding process of S3 will be described. In S3, the CPU 131A is configured to start rotating the drive shaft 725 of the second motor 72 in the reverse direction at the same time or after driving the drive shaft of the first motor 71 to rotate in the forward direction. That is, in the first feeding operation, the CPU 131A is configured to start rotating the drive shaft 725 of the second motor 72 in the reverse direction no earlier than driving the drive shaft of the first motor 71 to rotate in the forward direction to rotate the feed roller 41.

When the drive shaft of the first motor 71 rotates in the forward direction, the transmission mechanism 71A transmits the drive force of the first motor 71 to the feed roller 41. Accordingly, the transmission mechanism 71A rotates the feed roller 41 in the feeding direction indicated by the arrow 981 in FIG. 5.

When the drive shaft 725 of the second motor 72 rotates in the reverse direction, the shutter 81 is moved to its non-restricting position shown in FIG. 8A; the set guide 86 is moved to the second guiding position shown in FIG. 8A; and the pressing member 51 is moved to the pressing position. Also, in response to the rotation of the drive shaft 725 of the second motor 72 in the reverse direction, the reverse roller 46 rotates in the counter-feeding direction and the conveying rollers 91 and 92 rotate in the feeding direction.

Specifically, when the CPU 131A rotates the drive shaft 725 of the second motor 72 in the reverse direction, the drive force of the second motor 72 is transmitted to the gear 74E via the transmission mechanism 72A, shaft member 91A, transmission mechanism 73, and gears 74A-74D of the transmission mechanism 74, as illustrated in FIG. 6. When the second motor 72 rotates in the reverse direction, the one-way clutch in the gear 74E allows the shaft member 851 of the drive member 85 to freewheel. Accordingly, the cam 853 of the driven portion 85 is pivotally moved counterclockwise by the urging force of the spring 852.

When the cam 853 is pivoted counterclockwise, the urging force of the spring 84 can pivotally move the shutter 81 counterclockwise in a direction indicated by an arrow 962 in FIG. 8B. Consequently, the urging force of the spring 84 moves the shutter 81 out of the restricting position shown in FIG. 8B to the non-restricting position shown in FIG. 8A. In the non-restricting position, the extension parts 83A and 83C are separated from the first members 87A and 87B of the corresponding set guides 86A and 86B. The extension member 83 is thus retracted from the conveying path 20 and is separated away from the conveying path 20. The first members 87A and 87B are hence pivotally moved clockwise by the weight of their ends 872. Consequently, the second-direction-side surfaces 882 on the second members 88A and 88B are moved to the first-direction side relative to the surface 111 on the support member 11B. In other words, the set guide 86 moves to its second guiding position.

In the meantime, the drive force of the second motor 72 is also transmitted to the gear 75D via the transmission mechanism 72A, shaft member 91A, transmission mechanisms 73 and 74, and gears 75A-75C of the transmission mechanism 75. When the second motor 72 rotates in the reverse direction, the one-way clutch of the gear 75D allows the shaft member 61 of the cam 62 to freewheel. Accordingly, the shaft member 61 is rotated counterclockwise by the urging force of the spring 63 and the cam 62 is pivotally moved counterclockwise. When the cam 62 pivots counterclockwise, the cams 621 and 622 respectively separate from plate-shaped parts 5211 and 5221 of the pressing member 51. The urging forces of the first spring 54 and urging unit 55 move the pressing member 51 in the third direction indicated by an arrow 971 in FIG. 5. Thus, the pressure roller 52D of the pressing member 51 moves to the pressing position, protruding farther in the first direction than the lower surface of the second casing 12. By moving to the pressing position, the pressure roller 52D presses the sheets on the sheet-feed tray 16 toward the feed roller 41. This arrangement ensures a better separating and conveying operation with the feed roller 41 and reverse roller 46 than when the pressure roller 52D does not apply pressure to the sheets.

In response to the rotation of the drive shaft 725 of the second motor 72 in the reverse direction, the one-way clutch in the gear 722 of the transmission mechanism 72A transmits the drive force of the second motor 72 to the shaft member 92A, thereby rotating the conveying roller 92 counterclockwise, i.e., in the feeding direction. Further, when the drive shaft 725 of the second motor 72 rotates in the reverse direction, the gear 721 of the transmission mechanism 72A rotates the shaft member 91A counterclockwise. Consequently, the drive force of the second motor 72 is transmitted to the shaft member 91A, rotating the conveying roller 91 counterclockwise, i.e., in the feeding direction.

The drive force of the second motor 72 is also transmitted to the shaft member 47 via the transmission mechanism 72A, shaft member 91A, transmission mechanism 73, gears 74A and 74B of the transmission mechanism 74, and gears 471, 472 and 481. As a result, the reverse roller 46 rotates counterclockwise in a direction indicated by an arrow 952 in FIG. 5, i.e., in the counter-feeding direction.

Here, a timer (not shown) may be used in the first feeding process of S3 to keep track of the time that elapses after the drive shaft 725 of the second motor 72 starts rotating.

The CPU 131A then determines in S4 whether a period of time T1 has elapsed since the drive shaft 725 of the second motor 72 began to rotate. That is, the first feeding process of S3 is configured to be performed for the period of time T1. The period of time T1 should be at least equal to or greater than a length of time required for the urging force of the spring 84 to move the shutter 81 from its restricting position shown in FIG. 8B to its non-restricting position shown in FIG. 8A. For example, the period of time T1 may be set to 0.5 seconds. The CPU 131A is then configured to execute a halting process in S5 when determining that the period of time T1 has elapsed since the drive shaft 725 began rotating (S4: YES); and is configured to return to the process in S4 when determining that the period of time T1 has not elapsed (S4: NO).

<Halting Process>

When the CPU 131A determines in S4 that the period of time T1 has elapsed since the drive shaft 725 of the second motor 72 started rotating (S4: YES), the controller 131 is configured to perform the halting process in S5. In the halting process, the controller 131 halts the rotation of the drive shaft of the first motor 71 while continuing to rotate the drive shaft 725 of the second motor 72 in the reverse direction. Alternatively, in the halting process of S5, the CPU 131A may halt the rotation of the drive shaft in the first motor 71 and the rotation of the drive shaft 725 in the second motor 72.

Incidentally, as the feed roller 41 rotates in the feeding direction indicated the arrow 981 in FIG. 5 during the first feeding process of S3, the rotating feed roller 41 may push the leading edges of sheets against the shutter 81. In such cases, a frictional force generated between leading edges of the sheets and the shutter 81 may prevent the shutter 81 from moving out of the restricting position shown in FIG. 8B to the non-restricting position shown in FIG. 8A. Hence, in the present embodiment, the drive shaft of the first motor 71 is configured to stop rotating in the halting process of S5. Thus, the feed roller 41 is caused to stop its rotation in the feeding direction indicated by the arrow 981 in FIG. 5. That is, the rotational speed of the feed roller 41 during the halting process is zero, which means that the rotational speed of the feed roller 41 during the halting process is less than the rotational speed of the feed roller 41 during the first feeding process. Consequently, the leading edges of the sheets are no longer pressed against the shutter 81, reducing the frictional force generated between the sheets and the shutter 81.

Further, the controller 131 continues to rotate the drive shaft 725 of the second motor 72 in the reverse direction in the halting process of S5. When the drive shaft 725 of the second motor 72 is rotated in the reverse direction, a force acts on the shutter 81 in the direction for moving the shutter 81 toward the non-restricting position (i.e., in the direction shown by the arrow 962 in FIG. 8B) as in the first feeding process of S3. If the rotation of the drive shaft 725 is halted in the halting process of S5 rather than continued to rotate, the one-way clutch in the gear 74E allows the shaft member 851 of the drive member 85 to freewheel. Consequently, the spring 852 applies an urging force in the counterclockwise direction to the cam 853 shown in FIG. 8B and the spring 84 in turn applies an urging force to the shutter 81 in the direction to pivotally move the shutter 81 into the non-restricting position shown in FIG. 8A. Thus, in either case, the shutter 81 can be moved to the non-restricting position due to the urging force of the spring 84 in the halting process.

Incidentally, when the one-way clutch in the gear 74E is freewheeling, the urging force of the spring 852 causes the cam 853 to pivot counterclockwise, while the urging force of the spring 84 causes the shutter 81 to pivotally move counterclockwise, thereby moving the shutter 81 to the non-restricting position. The cam 853 does not urge the shutter 81 when the shutter 81 moves from the restricting position to the non-restricting position, while the cam 853 urges the shutter 81 when the shutter 81 moves from the non-restricting position to the restricting position. Hence, the urging force of the spring 84 should be greater than the frictional force between the sheets and the shutter 81, in order to move the shutter 81 from the restricting position to the non-restricting position. Otherwise, the shutter 81 cannot release its restriction on the sheets.

By executing the halting process in S5, even if the shutter 81 could not get out of the restricting position as a result of the first feeding operation of S3, the shutter 81 can reliably move to the non-restricting position from the restricting position.

The timer (not shown) may keep track of the time that elapses after the first motor 71 is halted in the halting process of S5.

Then, in S6, the CPU 131A determines whether a period of time T2 has elapsed since the first motor 71 was halted. That is, the halting process of S5 is configured to be performed for the period of time T2. The period of time T2 is a time duration equal to or greater than a length of time required for the urging force of the spring 84 to move the shutter 81 from the restricting position shown in FIG. 8B to the non-restricting position shown in FIG. 8A, for example. It is preferable that the period of time T2 be greater than or equal to the period of time T1, such as 0.5, 0.6, or 0.7 seconds. This is because there may be a case that the shutter 81 could not move from the restricting position to the non-restricting position during the first feeding process of S3 by the urging force of the spring 84 due to the frictional force between the leading ends of the sheets and the shutter 81. By configuring such that the CPU 131A waits a greater period of time (T2) than the period of time (T1) used for the first feeding process of S3, the shutter 81 could reliably move from the restricting position to the non-restricting position during the halting process of S5.

When determining in S6 that the period of time T2 has elapsed since the first motor 71 was halted (S6: YES), the CPU 131A is configured to perform a second feeding process in S7. However, the CPU 131A is configured to loop back to S6 when determining that the period of time T2 has not elapsed (S6: NO).

<Second Feeding Process>

When the CPU 131A determines in S6 that the period of time T2 has elapsed since the first motor 71 was halted (S6: YES), the CPU 131A is configured to perform the second feeding process in S7. In the second feeding process of S7, the CPU 131A is configured to start rotating the drive shaft of the first motor 71 in the forward direction and is also configured to rotate the drive shaft 725 of the second motor 72 in the reverse direction.

Here, the CPU 131A may begin driving the drive shaft 725 of the second motor 72 in the reverse direction before, after, or at the same time the CPU 131A begins driving the drive shaft of the first motor 71 in the forward direction.

When the drive shaft of the first motor 71 rotates in the forward direction, the transmission mechanism 71A transmits the drive force of the first motor 71 to the feed roller 41. Hence, the feed roller 41 undergoes a first operation in which the transmission mechanism 71A drives the feed roller 41 to rotate in the feeding direction indicated by the arrow 981 in FIG. 5.

Further, since the drive shaft 725 of the second motor 72 is rotated in the reverse direction, the set guide 86 is placed in the second guiding position shown in FIG. 8A, and the pressing member 51 is placed in the pressing position. Further, in response to the rotation of the drive shaft 725 of the second motor 72 in the reverse direction, the reverse roller 46 rotates in the counter-feeding direction, and the conveying rollers 91 and 92 rotate in the feeding direction.

Since the shutter 81 has moved to its non-restricting position, the sheets on the sheet-feed tray 16 are allowed to move down along the conveying path 20 in the feeding direction. At this time, since the set guide 86 is in its second guiding position, the second-direction-side surfaces 882 on the second members 88A and 88B constituting the set guide 86 are disposed on the first-direction side of the conveying path 20. Accordingly, the feed roller 41 contacts a bottom-most sheet among the plurality of sheets moving down the conveying path 20 in the feeding direction from the first-direction side. Further, the pressure roller 52D presses the sheets from the second-direction side against the feed roller 41. By the rotating feed roller 41 and reverse roller 46, the single bottommost sheet can be separated from the plurality of sheets and moved downstream in the feeding direction along the conveying path 20.

<Reading Process>

The conveying roller 91 contacts the bottom surface (i.e., surface facing in the first direction) of the separated sheet once the sheet has moved downstream in the feeding direction, and continues to convey the sheet in the feeding direction. In S8, the CPU 131A is configured to control the image reader 93 (see FIG. 2) disposed further downstream of the conveying roller 91 in the feeding direction to read the image on the bottom surface of the sheet, as the sheet moves over the image reader 93. The CPU 131A can receive output signals transmitted from the image reader 93 and convert the signals to digital data.

The conveying roller 92, which is disposed downstream of the image reader 93 in the feeding direction, then contacts the bottom surface of the sheet exiting the image reader 93 and continues to convey the sheet further downstream in the feeding direction. The conveying roller 92 discharges the sheet from the casing 10 through the discharge opening 10B into the discharge tray 18.

Subsequently, when the sheet sensor 125 detects in S9 that there still are sheets in the sheet-feed tray 16 (S9: YES), the CPU 131A returns to S8 to perform the reading operation to read an image from a bottom surface of a next sheet. When the sheet sensor 125 no longer detects the presence of sheets in the sheet-feed tray 16 in S9 (S9: NO), the CPU 131A is configured to return to S1 to perform the preliminary operation and wait for an input of a next read command.

<Rotational Speed of the Feed Roller>

In the embodiment, the CPU 131A is configured to control the rotational speed of the feed roller 41 in the first feeding process of S3 to be no greater than the rotational speed of the feed roller 41 in the second feeding process of S7. That is, the rotational speed of the feed roller 41 in the second feeding process of S7 is faster than the rotational speed of the feed roller 41 in the first feeding process of S3. For example, the rotational speed of the feed roller 41 may be set to 15 rpm in the first feeding process and 60 rpm in the second feeding process.

4. Operational and Advantageous Effects of the Embodiment

In the image-reading device 1 according to the embodiment, the CPU 131A is configured to execute the first feeding process in S3 for moving the shutter 81 to the non-restricting position at the same time or after (i.e., no earlier than) the CPU 131A rotates the feed roller 41 while the shutter 81 is in the restricting position. In this way, the leading edges of the sheets are allowed to contact the shutter 81 and become aligned with each other before they are fed. This method may increase the frictional force between the leading edges of the sheets and the shutter 81 due to the feed roller 41 applying a conveying force to the sheets, making it more difficult for the shutter 81 to move smoothly out of the restricting position. However, in the embodiment, the CPU 131A is configured to further execute the halting process of S5 to halt rotation of the feed roller 41 after executing the first feeding process in S3, thereby halting the conveying force applied by the feed roller 41. This operation (halting process) lessens the frictional force between the sheets and the shutter 81, enabling the shutter 81 to move to the non-restricting position. Thus, the method according to the embodiment can reduce the potential for sheet conveyance problems. Further, since the CPU 131A executes the second feeding process of S7 to rotate the feed roller 41 after executing the halting process of S5 and placing the shutter 81 in the non-restricting position, sheets can be conveyed without restriction from the shutter 81 during the second feeding process in S7.

In the embodiment described above, the CPU 131A is configured to execute the halting process of S5 for the period of time T2 (processing time T2) which is longer than or equal to the period of time T1 (processing time T1) for the first feeding process of S3. In other words, the processing time T2 for the halting process of S5, in which the rotation of the feed roller 41 is halted to reduce the frictional force between the sheets and the shutter 81 and allow the shutter 81 to move more easily to the non-restricting position, is greater than or equal to the processing time T1 of the first feeding process of S3. That is, setting the processing time T2 for the halting process of S5 greater than or equal to the processing time T1 for the first feeding process of S3 increases the likelihood that the shutter 81 will be able to move to the non-restricting position during the halting process of S5 even if the shutter 81 remained stuck in the restricting position during the first feeding process of S3.

Further, the CPU 131A of the controller 131 drives the feed roller 41 in the first feeding process of S3 at a speed no greater than the rotational speed of the feed roller 41 in the second feeding process of S7. That is, the rotational speed of the feed roller 41 in the second feeding process of S7 is not less than the rotational speed of the feed roller 41 in the first feeding process of S3. This configuration ensures that the force with which the leading edges of the sheets are pressed against the shutter 81 in the first feeding process of S3 will be no larger than that in the second feeding process of S7. Accordingly, the frictional force generated between the sheets and the shutter 81 in the first feeding process of S3 is less than or equal to that in the second feeding process of S7. Consequently, the shutter 81 has a greater possibility of moving into the non-restricting position in the first feeding process of S3 than in the second feeding process of S7. Further, the force with which the sheets contact the shutter 81 in the first feeding process of S3 due to the rotation of the feed roller 41 will be less than or equal to that in the second feeding process of S7, thereby reducing the possibility that the leading edges of the sheets will be damaged.

Various modifications are conceivable.

For example, the CPU 131A of the controller 131 may rotate the second motor 72 in its reverse direction to return the cam 62 and cam 853 to their original positions prior to performing the preliminary operation of S1. By adding this additional step, the shutter 81 can be more reliably placed in its restricting position when the second motor 72 is subsequently rotated in the forward direction.

Further, the drive force transmitted by the transmission mechanism 71A is not limited to the drive force of the first motor 71, provided that the transmission mechanism 71A can transmit a drive force for rotating the feed roller 41 in the feeding direction. For example, the transmission mechanism 71A may transmit the drive force of the second motor 72 or a drive force of another motor (not shown).

Further, the pressing member 51 is not essential to the structure of the image-reading device 1 of the embodiment.

Further, the period of times T1 and T2 are not necessarily limited to be 0.5 seconds, respectively, provided that the period of time T2 is set greater than or equal to the period of time T1. For example, the period of time T1 may be set to 0.6 seconds and the period of time T2 to 0.7 seconds. Further, the sheet feeder of the embodiment may be used in an inkjet printer, facsimile machine, and the like.

In the embodiment, the CPU 131A is configured to perform the halting process in S5 to halt the rotation of the feed roller 41. However, in place of the halting process, the CPU 131A may perform a speed-reduction process in S5 in order to reduce the rotational speed of the feed roller 41 from its rotational speed during the first feeding process of S3. This speed-reduction process can also reduce the conveying force that the feed roller 41 applies to the sheets, thereby lessening the frictional force generated between the shutter 81 and the leading edges of the sheets and allowing the shutter 81 to move more easily to its non-restricting position. Thus, this method can also reduce the potential for sheet conveyance problems. Further, in this speed-reduction process, the direction in which the feed roller 41 rotates is not limited to the feeding direction but may be the counter-feeding direction.

Figure 9:
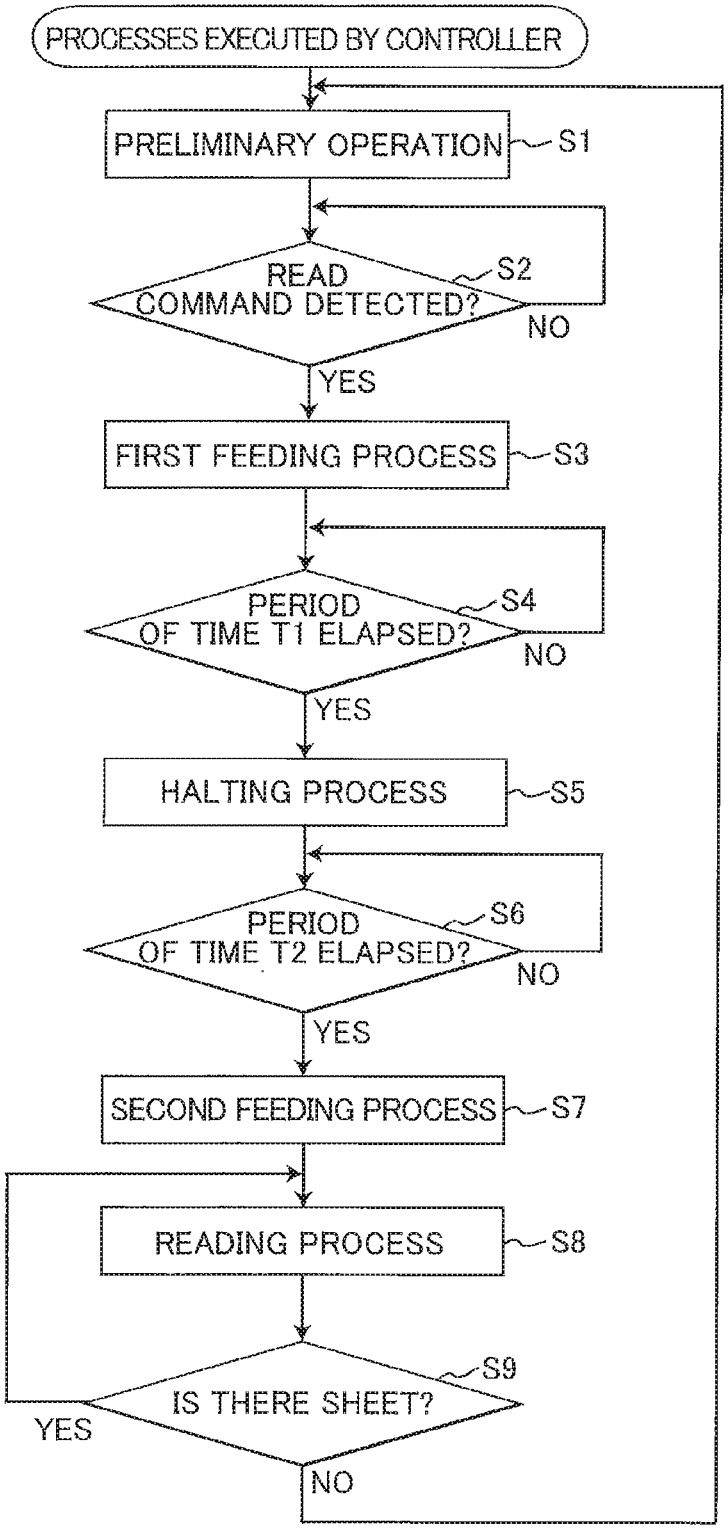
FIG. 9 is a flow chart executed by a controller 131 of the image-reading device 1 according to the embodiment.

The halting process of the embodiment and the speed-reduction process of the variation, which can be performed in S5 of FIG. 9, may be collectively called a reduction process in which the rotational speed of the feed roller 41 is less than the rotational speed of the feed roller 41 during the first feeding process of S3.

Further, the CPU 131A of the embodiment is configured to determine in S4 whether the period of time T1 has elapsed since the drive shaft 725 of the second motor 72 began rotating in the first feeding process of S3. However, the CPU 131A may determine whether the period of time T1 has elapsed since the first motor 71 began rotating in the first feeding process of S3.

While the description has been made in detail with reference to specific embodiments thereof, it would be apparent to those skilled in the art that various changes and modifications may be made therein without departing from the scope of the above described embodiments.

What is claimed is:

1. A sheet feeder comprising:

a feed roller configured to rotate to feed a sheet in a feeding direction, the sheet having a leading edge in the feeding direction;

a shutter configured to move between a restricting position and a non-restricting position, the shutter at the restricting position restricting the leading edge of the sheet to prevent the sheet from being conveyed by the feed roller in the feeding direction, the shutter at the non-restricting position releasing the restricting on the leading edge of the sheet to permit the sheet to be conveyed by the feed roller in the feeding direction; and a controller configured to control rotation of the feed roller and movement of the shutter, the controller being configured to perform:

a first feeding process of controlling the feed roller to rotate at a first rotational speed while the shutter is at the restricting position and of controlling the shutter to move to the non-restricting position from the restricting position no earlier than rotating the feed roller at the first rotational speed;

a reduction process of controlling a rotational speed of the feed roller to be less than the first rotational speed after performing the first feeding process; and a second feeding process of controlling the feed roller to rotate at a second rotational speed after performing the reduction process.

2. The sheet feeder as claimed in claim 1, wherein the reduction process is a halting process of halting rotation of the feed roller.

3. The sheet feeder as claimed in claim 2, further comprising:

a shaft member rotatably supporting the shutter;

a spring configured to urge the shaft member to rotate the shutter toward the non-restricting position;

a motor including a drive shaft configured to rotate in a first direction and in a second direction opposite the first direction to generate a drive force, the controller being configured to control rotation of the drive shaft;

a transmission mechanism mechanically connecting the drive shaft of the motor and the shaft member to transmit the drive force of the motor to the shaft member; and a clutch constituting part of the transmission mechanism, the clutch being configured to transmit the drive force to the shaft member in response to rotation of the drive shaft in the first direction, the clutch being configured to freewheel relative to the shaft member to prevent transmission of the drive force to the shaft member in response to rotation of the drive shaft in the second direction, wherein:

in the first feeding process, the controller is configured to rotate the drive shaft of the motor in the second direction no earlier than rotating the feed roller at the first rotational speed; and in the halting process, the controller is configured to halt rotation of the feed roller but being configured to rotate the drive shaft of the motor in the second direction.

4. The sheet feeder as claimed in claim 2, further comprising another motor including a drive shaft configured to rotate to generate a drive force to rotate the feed roller, the controller being further configured to control rotation of the drive shaft of the another motor to control rotation of the feed roller.

5. The sheet feeder as claimed in claim 2, further comprising:

a shaft member rotatably supporting the shutter;

a spring configured to urge the shaft member to rotate the shutter toward the non-restricting position;

a motor including a drive shaft configured to rotate in a first direction and in a second direction opposite the first direction to generate a drive force, the controller being configured to control rotation of the drive shaft;

a transmission mechanism mechanically connecting the drive shaft of the motor and the shaft member to transmit the drive force of the motor to the shaft member; and a clutch constituting part of the transmission mechanism, the clutch being configured to transmit the drive force to the shaft member in response to rotation of the drive shaft in the first direction, the clutch being configured to freewheel relative to the shaft member to prevent transmission of the drive force to the shaft member in response to halt of the rotation of the drive shaft, wherein:

in the first feeding process, the controller is configured to rotate the drive shaft of the motor in the second direction no earlier than rotating the feed roller at the first rotational speed; and in the halting process, the controller is configured to halt rotation of the feed roller and rotation of the drive shaft of the motor.

6. The sheet feeder as claimed in claim 1, wherein the controller is configured to perform the first feeding process for a first period of time; and wherein the controller is configured to perform the reduction process for a second period of time longer than the first period of time.

7. The sheet feeder as claimed in claim 1, wherein the second rotational speed is not less than the first rotational speed.

8. The sheet feeder as claimed in claim 1, further comprising a casing in which a sheet conveying path along which a sheet is configured to be conveyed is defined, wherein the shutter at the restricting position has a portion crossing the sheet conveying path, the shutter at the non-restricting position being separated away from the sheet conveying path.

9. The sheet feeder as claimed in claim 1, further comprising a separator configured to contact the feed roller and separate the sheet conveyed by the feed roller from another sheet.

10. A sheet feeder comprising:

a feed roller configured to rotate to feed a sheet in a feeding direction, the sheet having a leading edge in the feeding direction;

a shutter configured to move between a restricting position and a non-restricting position, the shutter at the restricting position restricting the leading edge of the sheet to prevent the sheet from being conveyed by the feed roller in the feeding direction, the shutter at the non-restricting position releasing the restricting on the leading edge of the sheet to permit the sheet to be conveyed by the feed roller in the feeding direction; and a controller configured to control rotation of the feed roller and movement of the shutter, the controller being configured to perform:

a first feeding process of controlling the feed roller to rotate at a first rotational speed while the shutter is at the restricting position and of controlling the shutter to move to the non-restricting position from the restricting position no earlier than rotating the feed roller at the first rotational speed;

one of a halting process of controlling the feed roller to halt rotation thereof and a speed-reduction process for controlling the feed roller to rotate at a rotational speed less than the first rotational speed after performing the first feeding process; and a second feeding process of controlling the feed roller to rotate after performing the one of the halting process and the speed-reduction process.

11. A sheet feeder comprising:

a casing in which a sheet conveying path along which a sheet is configured to be conveyed is defined;

a feed roller configured to rotate to feed the sheet in a feeding direction, the sheet having a leading edge in the feeding direction;

a shutter movably disposed in the casing, the shutter being configured to move between a first position crossing the sheet conveying path and a second position separated away from the sheet conveying path, the shutter at the first position being in contact with the leading edge of the sheet to be fed by the feed roller;

a motor including a drive shaft configured to rotate in a first direction and in a second direction opposite the first direction to generate a drive force, the shutter being movable from the second position to the first position in response to rotation of the drive shaft in the first direction, the shutter being movable from the first position to the second position in response to rotation of the drive shaft in the second direction;

a supporting member movably supporting the shutter;

an urging member configured to urge the supporting member to move the shutter toward the second position;

a transmission mechanism mechanically connecting the drive shaft of the motor and the supporting member to transmit the drive force of the motor to the supporting member;

a clutch constituting part of the transmission mechanism, the clutch being configured to transmit the drive force to the supporting member in response to rotation of the drive shaft in the first direction, the clutch being configured to freewheel relative to the supporting member to prevent transmission of the second drive force to the supporting member in response to rotation of the drive shaft in the second direction; and a controller configured to control rotation of the feed roller and rotation of the drive shaft of the motor, the controller being configured to perform:

a first feeding process of controlling the feed roller to start rotating while the shutter is at the restricting position and of controlling the drive shaft of the motor to start rotating to move the shutter to the non-restricting position from the restricting position no earlier than starting rotating the feed roller, the feed roller being configured to rotate at a first rotational speed;

a reduction process of controlling a rotational speed of the feed roller to be less than the first rotational speed after performing the first feeding process; and a second feeding process of controlling the feed roller to rotate at a second rotational speed greater than the rotational speed during the reduction process after performing the reduction process.

12. The sheet feeder as claimed in claim 11, wherein the supporting member is a shaft member pivotally movably supporting the shutter and the urging member is a spring provided on the shaft member.

13. The sheet feeder as claimed in claim 11, wherein the reduction process is a halting process of halting rotation of the feed roller.

14. The sheet feeder as claimed in claim 11, further comprising another motor including a drive shaft configured to rotate to generate a drive force to rotate the feed roller in the feeding direction, the controller being configured to control rotation of the drive shaft of the another motor to control rotation of the feed roller.

* * * * *